US007748816B2

(12) United States Patent
Koase

(10) Patent No.: US 7,748,816 B2
(45) Date of Patent: Jul. 6, 2010

(54) CURL PREDICTING METHOD AND LIQUID DISCHARGE DEVICE

(75) Inventor: Takashi Koase, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 104 days.

(21) Appl. No.: 12/275,646

(22) Filed: Nov. 21, 2008

(65) Prior Publication Data

US 2009/0147039 A1 Jun. 11, 2009

(30) Foreign Application Priority Data

Dec. 11, 2007 (JP) ..... 2007-319983

(51) Int. Cl.
*B41J 2/01* (2006.01)

(52) U.S. Cl. ..... 347/19

(58) Field of Classification Search ..... 347/5, 347/9, 14, 19; 358/1.1, 1.9, 3.23
See application file for complete search history.

(56) References Cited

U.S. PATENT DOCUMENTS 7,452,043 B2 * 11/2008 Ono et al. ..... 347/14
2009/0244634 A1 * 10/2009 Hasegawa et al. ..... 358/3.23

FOREIGN PATENT DOCUMENTS

| | | |
|---|---|---|
| JP | 2002-067357 | 3/2002 |
| JP | 2007-307763 | * 11/2007 |
| JP | 2009-143012 | * 7/2009 |
| JP | 2009-143013 | * 7/2009 |

OTHER PUBLICATIONS

Machine generated translation of JP 2002-67357, published on Mar. 2002.*

* cited by examiner

*Primary Examiner*—Huan H Tran
(74) *Attorney, Agent, or Firm*—Hogan Lovells US LLP

(57) ABSTRACT

A curl predicting method includes calculating liquid amount discharged to each of areas defined on a medium by a liquid discharge device for every area defined on the medium and predicting a curl state of the medium which is attributable to liquid discharged to the medium on the basis of a position of the area on the medium and the amount of the liquid discharged to the area.

8 Claims, 18 Drawing Sheets

PREDICTED CURL BASED ON DEFLECTION STRESS t

ACTUAL CURL

CURL PREDICTING METHOD AND LIQUID DISCHARGE DEVICE

BACKGROUND

1. Technical Field

The present invention relates to a curl predicting method and a liquid discharge device.

2. Related Art

As one kind of liquid discharge apparatuses, an ink-jet printer which performs printing by discharging ink from nozzles to a recording medium, such as paper, cloth, and film is familiar. Water-soluble ink is used in wide for the ink-jet printers. In the ink-jet printers using the water-soluble ink, in the case in which a range of variance of water amount on the upper surface of print paper is large, the print paper is likely to curl.

JP-A-2002-67357 discloses a curl predicting method in which when the amount of ink coated on print paper is equal to or greater than a threshold value, it is predicted such that the paper curls.

However, although the paper is coated with the same amount of ink, curling manners are different for different cases in which ink is coated on the entire area of paper and in which ink is locally coated on paper. Accordingly, in the case in which the paper curling is predicted only depending on the amount of ink coated on paper as described in the known curl predicting method, the prediction may be erroneous.

SUMMARY

An advantage of some aspects of the invention is to provide a curl predicting method by which a curl state can be precisely predicted.

According to one aspect of the invention, there is provided a curl predicting method including a step of calculating liquid amount discharged to each of areas by a liquid discharge device for every area on a medium and a step of predicting a curl state of the medium which is attributable to liquid discharge to the medium on the basis of both of a position of the area on the medium and the liquid amount discharged to the area.

Other advantages will be apparent from the specification and the accompanying drawings.

That is, the invention relates to a curl predicting method including calculating liquid amount discharged to each of areas defined on a medium by a liquid discharge device for every area defined on the medium, and predicting a curl state of the medium which is attributable to liquid discharged to the medium on the basis of both of a position of the area on the medium and the amount of the liquid discharged to the area.

According to this curl predicting method, since the curl state changes according to a position of the medium to which liquid is discharged, it is possible to precisely predict the curl state of the medium.

In the curl predicting method, it is preferable that the liquid amount is converted to force which causes the medium to curl for every area and a degree of curl (referred to as curl amount) for the corresponding area is predicted on the basis of the force which causes the medium to curl.

With such a predicting method, it is possible to predict the curl amount for every area.

In the curl predicting method, it is preferable that when converting the liquid amount to the force which causes the medium to curl, force which causes the medium to curl in a predetermined direction of the medium and force which causes the medium to curl in a direction which perpendicularly intersects the predetermined direction of the medium are differently set.

With such a curl predicting method, since the liquid amount is converted to the force which causes the medium to curl in the different directions (the force which causes the medium to curl in the predetermined direction and the force which causes the medium to curl in the perpendicular direction to the predetermined direction), it is possible to predict more precisely the curl state of the medium. Further, the medium is the most likely to curl in a certain direction which is determined according to arrangement of fiber in the medium. Accordingly, with the same amount of liquid, if the force is set in a manner such that force which causes the medium to curl in a direction in which it is relatively easy for the medium to curl is stronger than force which causes the medium to curl in a direction in which it is relatively hard for the medium to curl, it is possible to more precisely predict the curl state of the medium.

In the curl predicting method, it is preferable that when converting the liquid amount of a certain area to the force which causes the medium to curl in a predetermined direction of the medium, the liquid amount of an area which parallels a certain area in a direction which perpendicularly intersects the predetermined direction more significantly affects the curl sate of the medium than the liquid amount of an area which parallels the certain area in the predetermined direction; and when converting the liquid amount of the certain area to the force which causes the medium to curl in the direction which perpendicularly intersects the predetermined direction of the medium, the liquid amount of an area which parallels the certain area in the predetermined direction more significantly affects the curl state of the medium than the liquid amount of an area which parallels the certain area in the direction which perpendicularly intersects the predetermined direction.

With such a curl predicting method, since the medium is an integrated object, a phenomenon in which neighboring areas of the certain area may also curl by the influence of the force which causes the certain area of the medium to curl is taken into account. Further, a phenomenon in which the medium is likely to curl in a direction which intersects a direction in which liquid is discharged over a longer length is taken into account. Accordingly, it is possible to more precisely predict the curl state.

In the curl predicting method, it is preferable that the force of causing a curl is force which causes the medium to curl in a manner such that a surface of the medium to which the liquid is discharged becomes an inside surface, moment force generated at a certain area by a weight of a portion of the medium which ranges from the certain area to an area at an end of the medium is calculated for every area, and a curl state of each of the areas is predicted for every area on the basis of a difference between the force and the moment force.

With such a curl predicting method, since a point in which the force which causes the medium to curl is suppressed by the weight of the paper is taken into account, it is possible to more precisely predict the curl state of the medium.

In the curl predicting method, it is preferable that in the case in which the force for the certain area is stronger than the moment force for the certain area, it is predicted such that the area be curled, but in the case in which the force for the certain area is equal to or weaker than the moment force, it is predicted such that the area be not curled.

With such a curl predicting method, it is possible to predict the curl state when the medium curls in a manner such that the liquid-discharged surface of the medium becomes the inside surface.

In the curl predicting method, it is preferable that the curl amount for an area at a center portion of the medium is determined to have a predetermined value, a curl amount for a certain area is calculated on the basis of the curl amount for an adjacent area which is adjacent to the certain area in a direction toward the center portion of the medium, and the curl amount for each of the adjacent areas is calculated in sequence order from the area at the center portion of the medium to an area at an end portion of the medium.

With such a curl predicting method, since a point in which it is hard for the center portion of the medium to curl in comparison with the end portion of the medium is taken in account for prediction, it is possible to more precisely predict the curl state of the medium.

According to another aspect of the invention, there is provided a liquid discharge device including a nozzle for discharging liquid to a medium, and a control portion which produces image data for discharging liquid from the nozzle, in which the control portion calculates amount of liquid discharged to an area of the medium which corresponds to an area defined in the image data, and predicts a curl state of the medium which is attributable to the liquid discharged to the medium on the basis of a position of the area on the medium and the amount of the liquid discharged to the area.

With such a liquid discharge device, since the curl state of the medium varies according to the position on the medium to which the liquid is discharged, it is possible to more precisely predict the cult state of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Line Head Printer

Hereinafter, an ink-jet printer will be described as an example of a liquid discharge device and more particularly a line head printer (printer 1) will be exemplified as the ink-jet printer.

Figure 1:
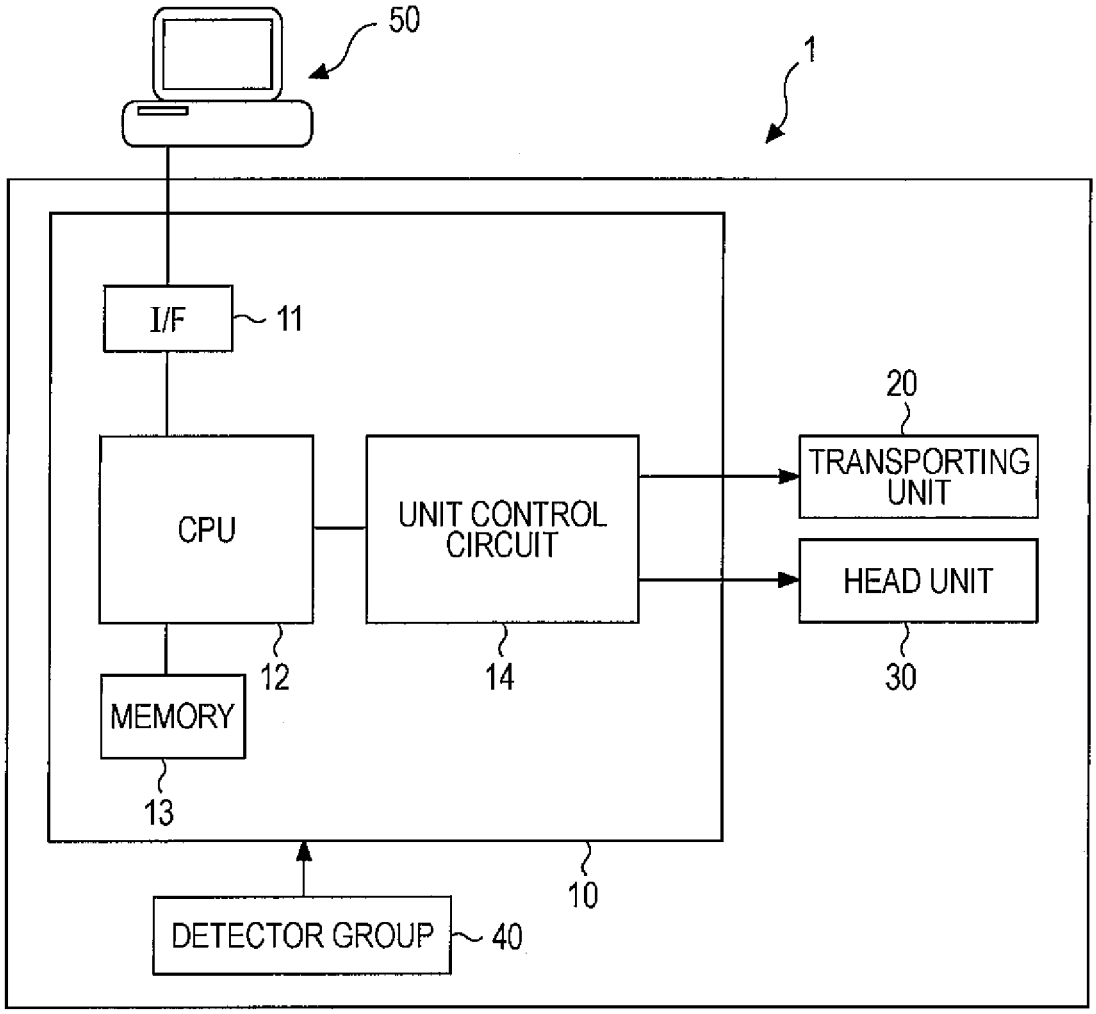
FIG. 1 is a block diagram illustrating an entire structure of a printer according to one embodiment of the invention.
Figure 2A:
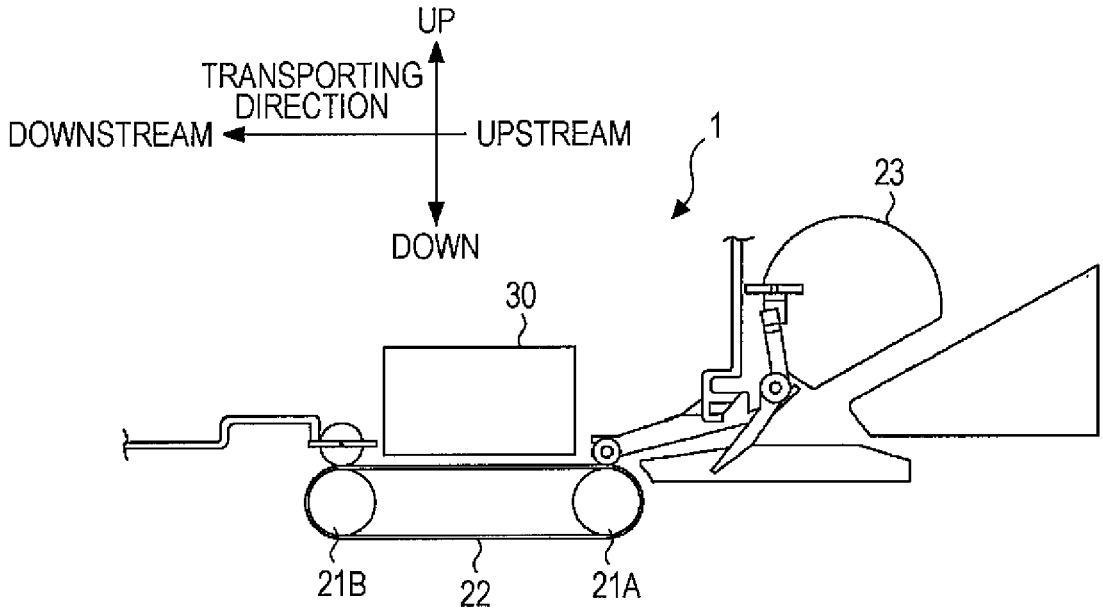
FIG. 2A is a sectional view illustrating a printer and FIG. 2B is view illustrating an operation in which the printer transports paper.
Figure 2B:
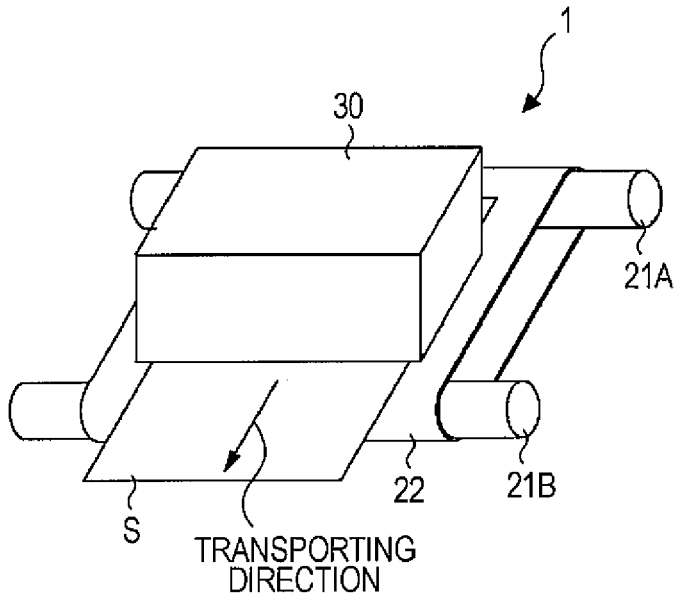

FIG. 1 is a block diagram illustrating an entire structure of a printer 1 according to one embodiment of the invention. FIG. 2A is a sectional view illustrating the printer 1. FIG. 2B shows an operation in which the printer 1 transports paper S (a medium). The printer 1 which received print data from a computer 50 which is an external device controls all units (a transporting unit 20 and a head unit 30) by a controller (control portion) 10 and forms an image on paper S. Situations inside the printer 1 are monitored by a detector group 40 and the controller 10 controls all of the units on the basis of the detection result.

The controller 10 is a control unit for controlling the printer 1. An interface portion 11 performs reception and transmission of data between the computer 50, which is an external device, and the printer 1. A CPU 12 is an arithmetic processing unit for controlling the printer 1 overall. A memory 13 provides an area for storing a program of the CPU 12 therein and an operation area. The CPU 12 controls each of the units by a unit control circuit 14 according to a program stored in the memory 13.

The transporting unit 20 includes transporting rollers 21A and 21B, a transporting belt 22, and a adsorbing mechanism 24. The transporting unit 20 sends paper S to a printable position and transports the paper S in a transporting direction of the paper at predetermined transportation speed when printing. A paper feeding roller 23 is a roller for automatically feeding paper S inserted into a paper inserting hole onto the transporting belt 22 inside the printer 1. Since the transporting belt 22 in the form of a wheel is rotated by the transporting rollers 21A and 21B, the paper S on the transporting belt 22 is transported. The paper S is adsorbed to the transporting belt 22 by electrostatic adsorption or vacuum adsorption (not shown).

The head unit 30 is a unit for discharging ink to paper and has a plurality of heads 31. A lower surface of each of the head 31 is provided with a plurality of nozzles which are ink discharge portions. In each of the nozzles, a pressure chamber (not shown) storing ink therein and a driving element (piezoelectric element) for discharging ink by changing a volume of the pressure chamber are provided. As a driving signal is applied to the driving element, the driving element deforms. Further, as the pressure chamber expands or contracts according to such deformation of the driving element, ink is discharged.

Figure 3:
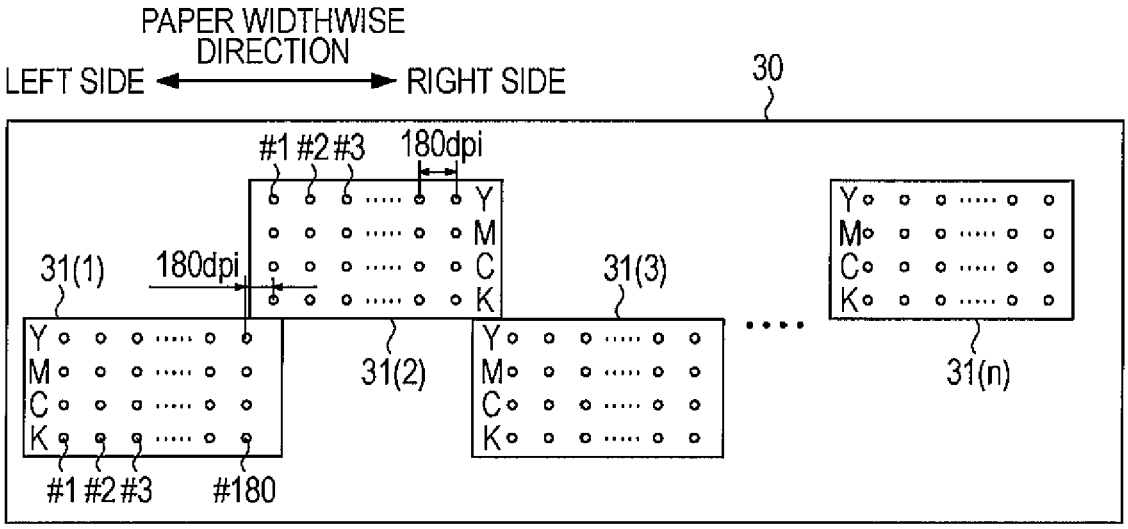
FIG. 3 is a view illustrating nozzle arrangement on a lower surface of a head unit.

FIG. 3 shows nozzle arrangement provided on the lower surface of the head unit 30. The heat unit 30 includes a plural number (n) of heads 31. The heads 31 are placed in a zigzag form in a widthwise direction of the paper S which intersects the paper transporting direction. The lower surface of the head 31 is provided with a yellow ink nozzle column Y, a magenta ink nozzle column M, a cyan ink nozzle column C, and a black ink nozzle column K. Each nozzle column includes 180 nozzles. The nozzles of each of the nozzle columns are aligned at a regular interval of 180 dpi in the widthwise direction. The heads 31 are placed in a manner such that, of two heads 31, distance between the rightmost nozzle (for example, 31(1) #180) of the left side head and the leftmost nozzle (for example, 31(2) #1) of the right side head is 180 dpi. That is, four colors of nozzles YMCK parallel one another in the widthwise direction of the paper at regular intervals of 180 dip, respectively in the head unit 30.

In such a line head printer, when the controller 10 receives print data, the controller 10 rotates the paper roller 23, and therefore the paper S, a printing object, is sent to the upper surface of the transporting belt 22. The paper S is transported on the transporting belt 22 at constant speed without stopping and passes under the head unit 30. While the paper S passes under the head unit 30, ink is intermittently discharged from each of the nozzles. As a result, dot columns, each made up of a plurality of dots, are formed on the paper S in the transporting direction, and thus an image is printed.

The print data is produced by a printer driver installed in the computer 50. The printer driver produces image data when it receives data relating to an image to be printed from various kinds of application software. The image data means a pack of pixel data and the pixel data is data which indicates whether to form dots at pixels which are imaginarily defined on print paper. The printer driver performs resolution conversion by converting resolution of data output from the application software to resolution for printing (print resolution). Further, the printer driver performs color conversion processing to convert data represented in RGB space so as to match with ink YMCK of the printer. After that, high gradation data (256 gray levels) is converted to printable gradation values (half tone processing) and therefore image data is produced. The printer driver delivers the produced image data to a curl predicting processing program and predicts a curl state of print paper. The curl predicting processing program is installed in the computer 50 like the printer driver. The printer driver performs anti-curling processing (which will be described later) in the case in which a curl amount (a degree of curl) predicted by the curl predicting processing program is larger than a threshold value. On the other hand, if the curl amount is not larger than the threshold value, the image data arranged in a matrix form is arranged in order in which it is transmitted to the printer 1 (rasterizing processing), and then the image data is sent to the printer 1 as print data along with command data relating to a printing method.

About Paper Curling

Figure 4:
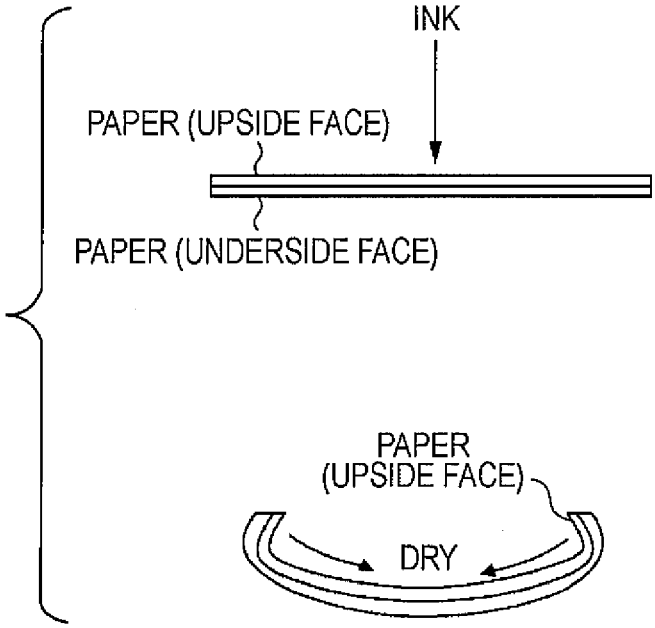
FIG. 4 is a view illustrating a curl of print paper when performing single-sided printing.

FIG. 4 shows curling of print paper occurring in the case of single-sided print. In ink-jet printer, aqueous ink is most likely to be used. Accordingly, if an image is printed on only a single side of paper, water (solvent component of ink) invades into the fiber of the print paper, and therefore the upper surface of print paper swells. As a result, the print paper curls in a manner such that the upper surface of the print paper bulges (not shown). After that, water permeated into the fiber of the print paper evaporates and then the upper surface of the print paper contracts more than before. As a result, as shown in FIG. 4, the print paper curls such that the print surface becomes an inside surface. Even in the double-sided print as well as the single-sided print, if the difference between ink placement amounts on the upper and lower surfaces of the paper is large, the paper curls due to the difference between expansion and contraction rates.

In a serial printer which is different from the printer according to the embodiment, printing is accomplished in a manner such that a paper transporting operation and an image forming operation in which the head discharges ink while it is moving are alternately performed. For such a reason, printing is performed, drying ink on the paper. On the other hand, in the line head printer according to the embodiment, since ink is discharged to the paper which is transported, printing speed is high but ink is not dried in the middle of printing. Accordingly, curling of paper is likely to occur. If the paper curls, the paper is not neatly stacked when the paper is discharged. That is, a problem such that the paper bends occurs.

Accordingly, it is an object of the invention to suppress curling of print paper. In order to accomplish the object, it is predicted whether paper curls or not, and anti-curling processing is performed in the case in which it is predicted such that the print paper curls. Hereinafter, a paper curl predicting method and paper anti-curling processing will be described.

Paper Curl Predicting Method According to a Comparative Example

First, a curl predicting method according to a comparative example which is different from the embodiment will be described. In the curl predicting method according to the comparative example, data (for example, the number of dots to be formed, the amount of ink to be discharged) relating to ink discharge is calculated on the basis of image data (data representing whether to form a dot for each pixel) which is produced by the printer driver. In the case in which the value of data relating to the ink discharge is larger than a threshold value, it is determined such that curl is likely to occur if printing is performed in the current state. Conversely, in the case in which the value of data relating to the ink discharge is equal to or smaller than the threshold value, it is determined such that the curl is not likely to occur. That is, in the curl predicting method according to the comparative example, only the amount of ink placed on the print paper serves as the reference level for predicting the occurrence of curling.

Figure 5A:
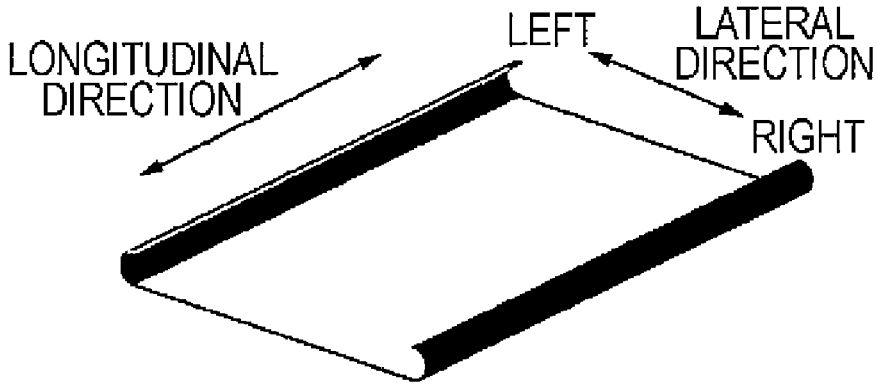
FIG. 5A and FIG. 5B are views illustrating different types of curls occurring according to an ink-placed position.
Figure 5B:
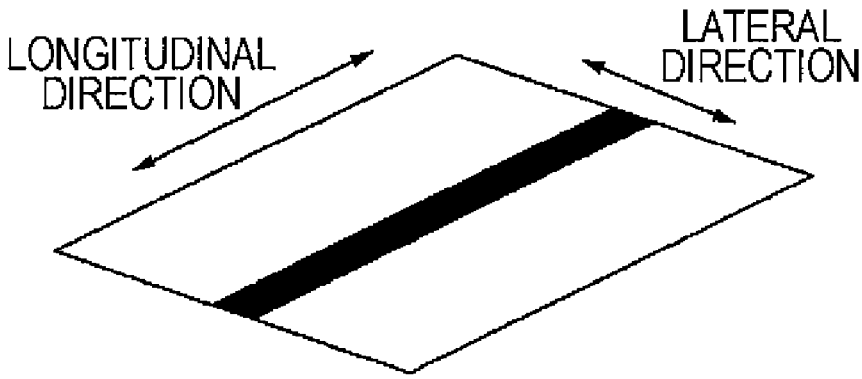

FIGS. 5A and 5B show different curls which occur according to difference of ink placement positions. With respect to FIGS. 5A and 5B, the same amount of ink (X ml) is placed at different positions of paper. In the paper of FIG. 5A, X/2 ml of ink is placed at left and right end portions of the paper in the lateral direction of the paper. In the paper of FIG. 5B, X ml of ink is placed at the center portion of the paper in the lateral direction of the paper. As a result, the paper of FIG. 5A curls at the left and right end portions thereof at which the ink is placed but the paper of FIG. 5B does not curl.

That is, although the same amount of ink is placed on the paper, the curling may occur or may not occur according to the ink placement position. Accordingly, if the occurrence of curling is determined according to only the ink amount placed on the paper like the curl predicting method according to the comparative example, it is impossible to precisely predict the occurrence of curling.

Accordingly, it is an object of the embodiment to precisely predict the occurrence of paper curling as precisely as possible. With this embodiment, a curl state of paper is predicted on the basis of the ink placement position as well as the ink amount placed on the paper. That is, a curl state of paper is predicted on the basis of distribution of ink placed on the paper. The curl state means, for example, the occurrence of curling, the degree of curl (curl amount), and the position of curl.

Curl Predicting Method According to One Embodiment

Figure 6:
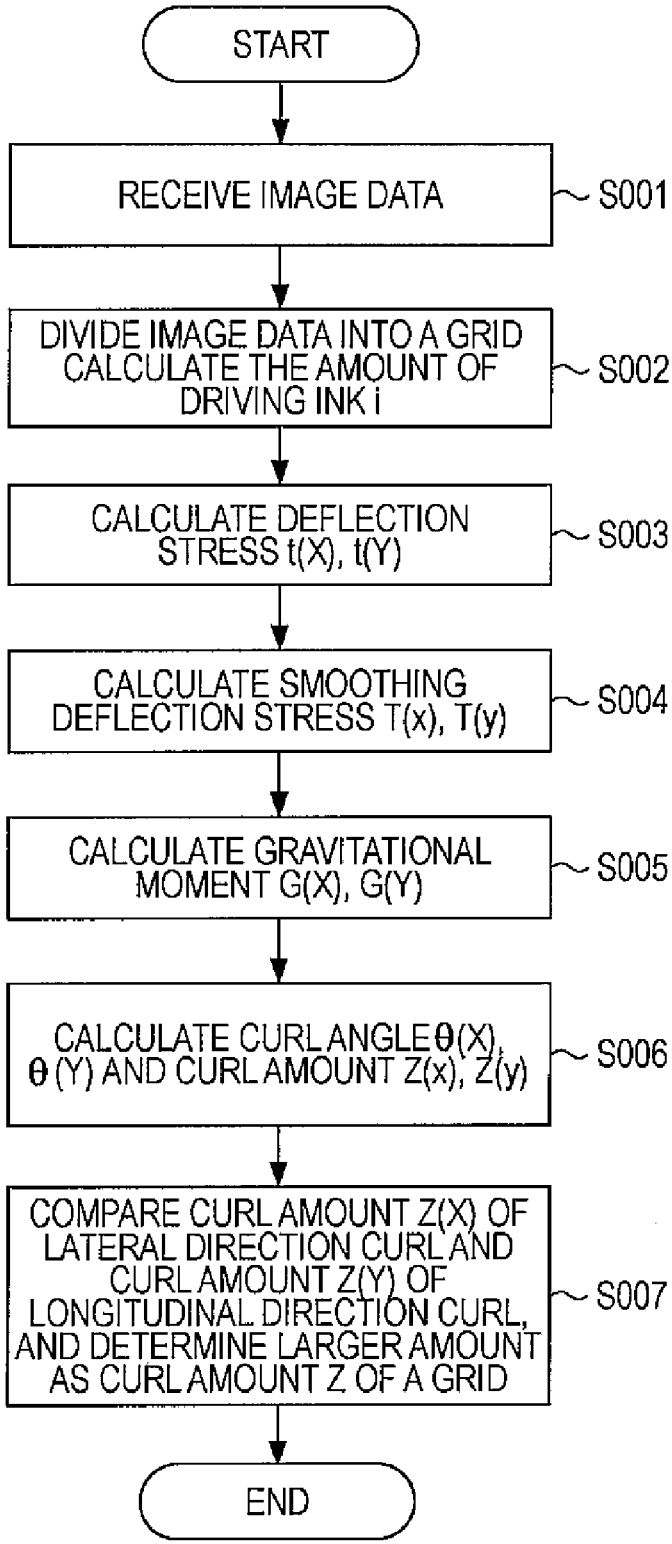
FIG. 6 is flow of curl predicting processing.

FIG. 6 shows flow of curl predicting processing according to one embodiment of the invention. When a curl predicting processing program receives the image data (data to represent presence of dots for pixels) produced by the printer driver (S001), the curl predicting processing program causes the computer 50 to execute the following processing S002 to S007 on the basis of the image data. Thus, the curl state of the paper after printing is predicted. Hereinafter, the curl predicting method will be described in detail.

S002: Calculate Ink Amount I for Each Section of a Grid

Figure 7A:
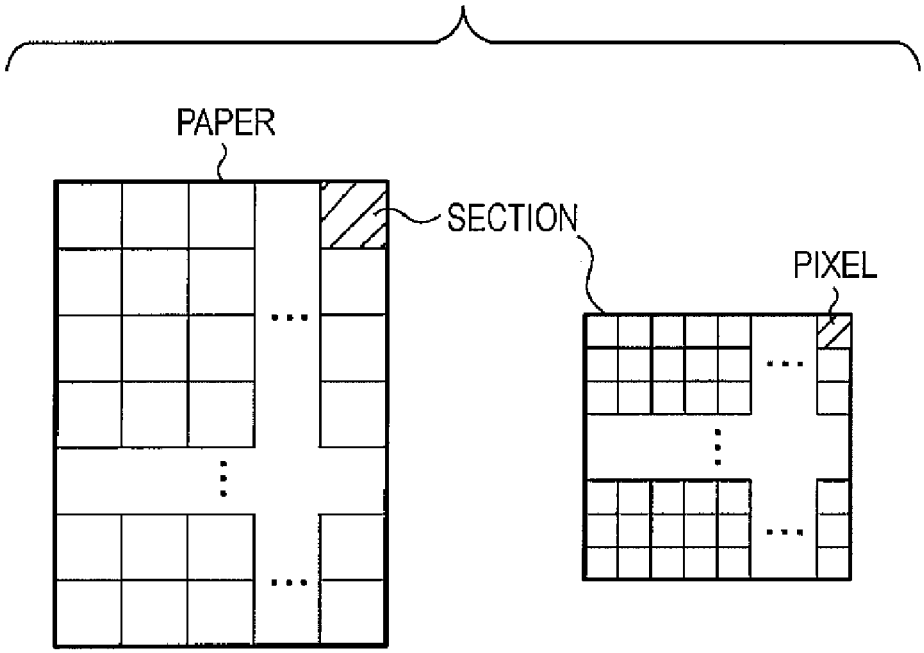
FIG. 7A is a view illustrating a relationship between a grid section of a grid and a pixel.

FIG. 7A shows a relationship between an area (a section of a grid) defined on the paper and pixels. The curl predicting processing program divides the image data corresponding to a sheet (a page) of print paper into a predetermined number of areas. This area is called a grid section (a section of a grid). The grid section is an area having a size corresponding to a bunch of pixels. For example, when a size of one grid section is 12.7 mm×12.7 mm (0.5 inch×0.5 inch) and print resolution is 180 dpi×180 dpi, a single grid section is composed of 90×90 pixels. If the paper size is 4 inch×6 inch, the image data is composed of 96 grid sections (8 sections×12 sections). The curl predicting processing program calculates the ink amount placed on each grid section on the basis of the image data produced by the printer driver.

Figure 7B:
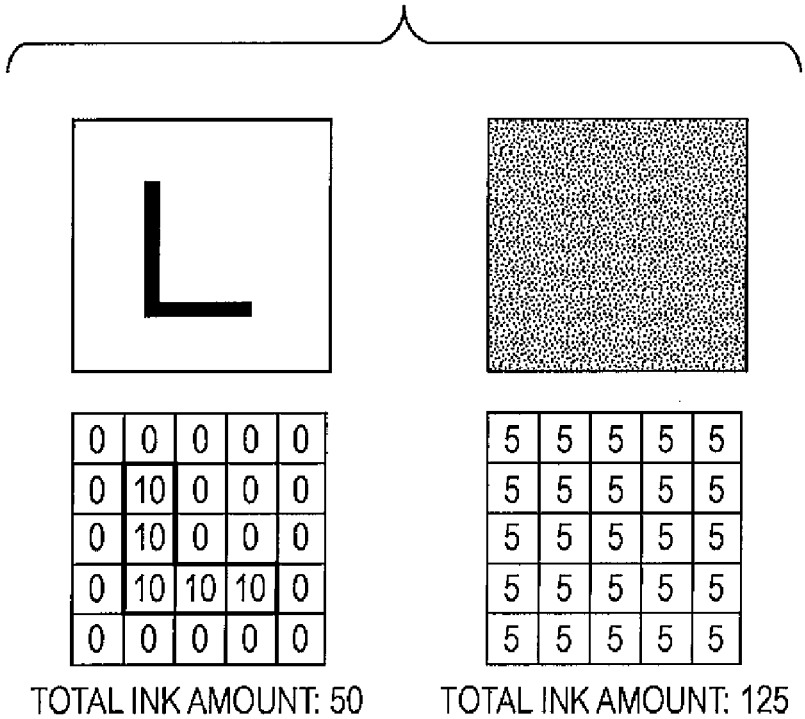
FIG. 7B is a view illustrating difference of a grid provided with a text image and a grid provided with an entire area-filled image.

FIG. 7B shows the difference of the ink placement amounts in a grid section with the letter L and in a grid section with a solid image of gray color. For convenience's sake of explanation, it is assumed that one grid section includes 25 pixels (5×5 pixels). Here, when a solid image (for example, photograph) is printed, the paper more easily curls in comparison with the case of printing the text image. This is because the ink amount placed on the paper is larger in the case of printing the solid image than the case of printing the text image. When observing each grid section (see FIG. 7B), the ink amount placed at the grid section in which the letter L is printed is 50, but the ink amount placed at the grid section in which the solid image is printed is 125. However, when observing the image data pixel by pixel, the maximum ink placement amount of a singe pixel of the pixels belonging to the single grid section in which a character is printed is 10, but the maximum ink placement amount of a pixel of the pixels belonging to the grid section in which the solid image is printed is less than 5. That is, in a text image, the ink is locally placed at some portion of the pixels. Accordingly, when observing a grid section which is a larger than the pixel, the ink placement amount of the solid image is larger than that of the text image. However, when observing in a smaller unit, pixel by pixel, there is the probability that the ink placement amount of a single pixel of pixels constituting the text image is larger than the ink placement amount of a single pixel of pixels constituting the solid image.

In a next step (S003), force of curling (corresponding to curling force, hereinafter referred to as deflection stress) by which the paper is likely to curl is calculated for each grid section on the basis of the ink placement amount calculated for each grid section (details thereof will be described later). In the case in which it is assumed that deflection stress is calculated for each pixel on the basis of the ink placement amount calculated for each pixel rather than for each grid section, deflection stress of some pixels constituting the text image is larger than deflection stress of pixels constituting the solid image, and there is the possibility that it is predicted that the degree of curl (curl amount) of the paper with the text image printed thereon is greater than that of the paper with the solid image printed thereon. This contradicts the phenomenon in which the paper with the solid image printed thereon more easily curls than the paper with the text image printed thereon.

Here, as described in the embodiment, one page of image data is divided into grid sections (areas imaginarily defined on a medium) which is a larger area than a pixel, and the ink amount placed on the paper is calculated for every grid section. On the basis of the ink amount placed in each of the grid sections, the deflection stress of the paper is calculated. Accordingly, it is possible to more precisely predict the curl state of the paper.

S003: Calculation of Deflection Stress

Figure 8A:
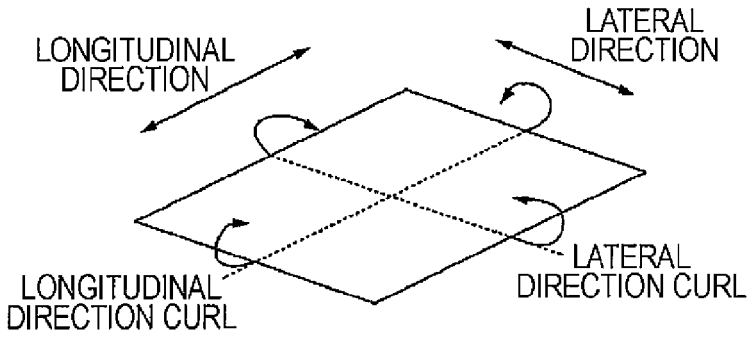
FIG. 8A is a view illustrating a direction in which paper curls.

FIG. 8A shows a direction in which the paper curls. With this embodiment, it is predicted such that the paper curls in a manner such that the surface (print surface) of paper on which the ink is placed becomes the inside surface. In S003, deflection stress which is the force by which the paper curls is calculated. Since the paper has four sides, as shown in the figure, there are two kinds of curl, that is, the paper curls in the lateral direction (corresponding to predetermined direction), (hereinafter, referred to as lateral direction curl), and the paper curls in the longitudinal direction (corresponding to interesting direction), (hereinafter, referred to as longitudinal direction curl). The lateral direction curl means the case in which areas arranged in the lateral direction of the paper curl in an arc form. The longitudinal direction curl means the case in which areas arranged in the longitudinal direction of the paper curl in an arc form.

Figure 8B:
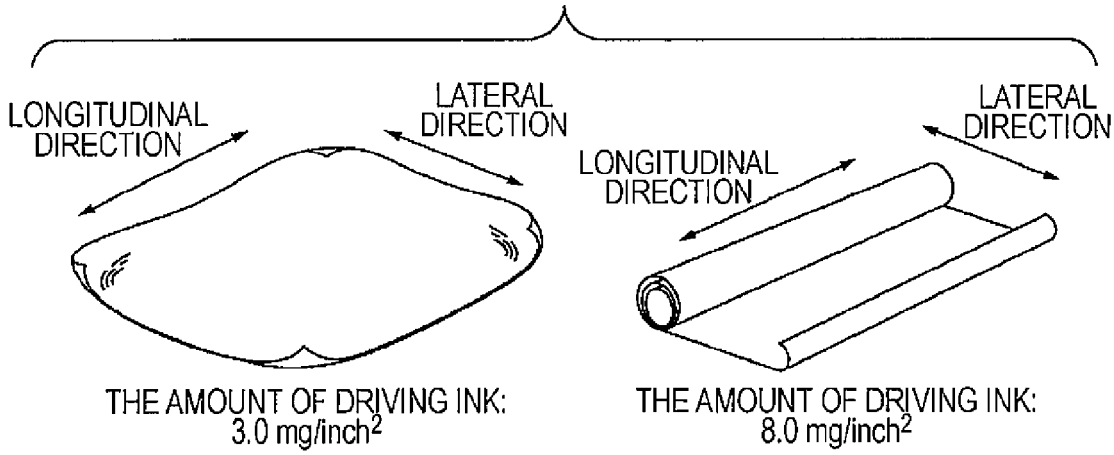
FIG. 8B is a view illustrating a direction in which paper is likely to curl.

FIG. 8B shows a direction in which the paper easily curls. The paper has a direction in which fiber (or grain) of paper is arranged. In the paper used in this embodiment, pieces of fiber are arranged in the longitudinal direction. In this case, it is easy for the paper to curl in the lateral direction. In particular, in the case in which ink placement amount is small (3.0 mg/inch$^2$), the curl states of the lateral direction curl and the longitudinal direction curl are almost the same. However, as the ink placement amount becomes larger (8.0 mg/inch$^2$), the lateral direction curl is more likely to occur than the longitudinal direction curl.

In the above description, with this embodiment, the deflection stress t(x) with respect to the lateral direction curl and the deflection stress t(y) with respect to the longitudinal direction curl are separately calculated on the basis of the ink placement amount for each grid section.

Figure 8C:
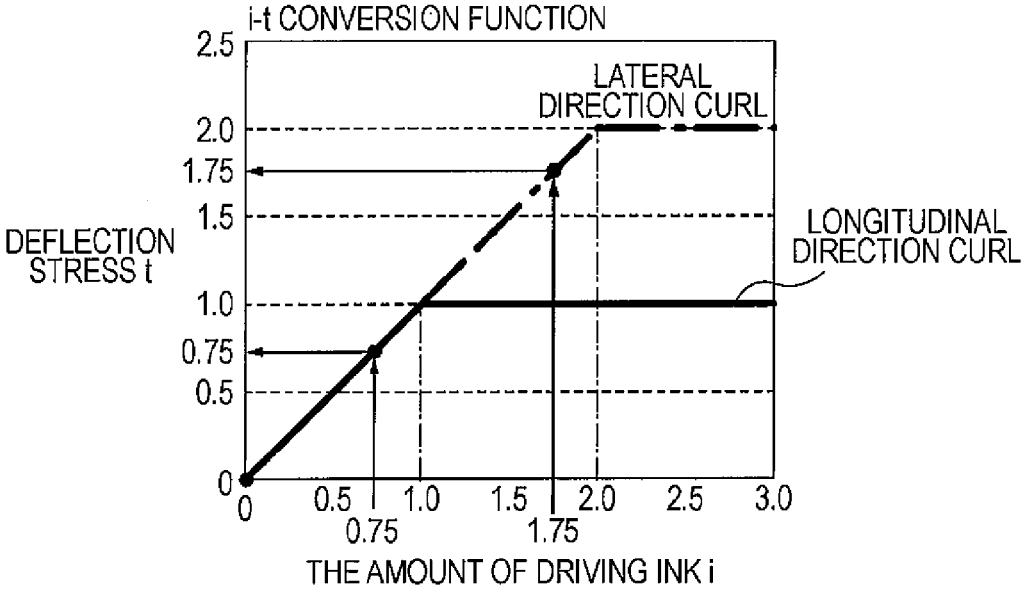
FIG. 8C is a view illustrating a conversion function of ink placement amount and deflection stress.

FIG. 8C shows a conversion function between the ink placement amount i and the deflection stress t. The abscissa axis represents the ink placement amount i for each grid section, and the vertical axis represents the deflection stress t. For example, in the case in which the ink placement amount of a certain grid section is 0.75, the deflection stresses (t(x), t(y)) corresponding to the ink placement amount 0.75 is 0.75. The ink placement amount i and the deflection stress are dimensionless values. In this manner, the deflection stress t is calculated from each ink placement amount by using the ink placement amount i–deflection stress t conversion function (hereinafter, referred to as i–t conversion function). The i–t conversion function is calculated by experiment results or experiences.

In the i–t conversion function, when the ink placement amount i is equal to or lower than 1.0, the lateral direction curl conversion function and the longitudinal direction curl conversion function are almost the same. On the other hand, when the ink placement amount i is higher than 1.0, the conversion function (dotted-dashed line) to the deflection stress t(x) with respect to the lateral direction curl and the conversion function (solid line) to the deflection stress t(y) with respect to the longitudinal direction curl are different.

Accordingly, the ink placement amount i is equal to or lower than 1.0, the deflection stress t(x) with respect to the lateral direction curl and the deflection stress t(y) with respect to the longitudinal direction are calculated, showing the results having the same value. For example, as described above, when the ink placement amount is 0.75, each of the deflection stress t(x) with respect to the lateral direction curl and the deflection stress t(y) with respect to the longitudinal direction is 0.75 (i=0.75->t(x)=t(y)=0.75). On the other hand, if the ink placement amount i is higher than 1.0, the deflection stress t(x) with respect to the lateral direction curl is larger than the deflection stress t(y) with respect to the longitudinal direction curl. For example, when the ink placement amount is 1.75, the deflection stress t(x) with respect to the lateral direction curl is 1.75, and the deflection stress t(y) with respect to the longitudinal direction curl is 1.0 (i=1.75->t(x)=1.75, t(y)=1.0)

With this embodiment, the conversion function to the deflection stress t(x) with respect to the lateral direction curl and the conversion function to the deflection stress t(y) with respect to the longitudinal direction curl are different from each other. In greater detail, the saturated deflection stress of the conversion function for the lateral direction curl and the saturated deflection stress of the conversion function for the longitudinal direction are differently set.

When the ion placement amount i is higher than 1.0, although the ink amount placed at the grid section is increased, the deflection stress t(y) with respect to the longitudinal direction curl is 1.0. That is, the maximum deflection stress t(y) with respect to the longitudinal direction curl is 1.0. On the other hand, the deflection stress t(x) with respect to the lateral direction curl is increased as the ink placement amount is increased from 1.0 to 2.0. However, if the ink placement amount is higher than 2.0, although the ink amount placed at the grid section is increased, the deflection stress is not larger than 2.0. That is, the maximum deflection stress of the deflection stress t(y) with respect to the lateral direction curl is 2.0.

As a result, when the ink placement amount is small, it is possible to predict the curl state of the paper by reproducing the phenomenon in which the curl states of the lateral direction curl and the longitudinal direction curl are almost the same. On the other hand, when the ink placement amount is large, it is possible to predict the curl state by reproducing the phenomenon in which the lateral direction curl more easily occurs than the longitudinal direction curl. As a result, it is possible to more precisely predict the curl state of the paper.

Figure 9:
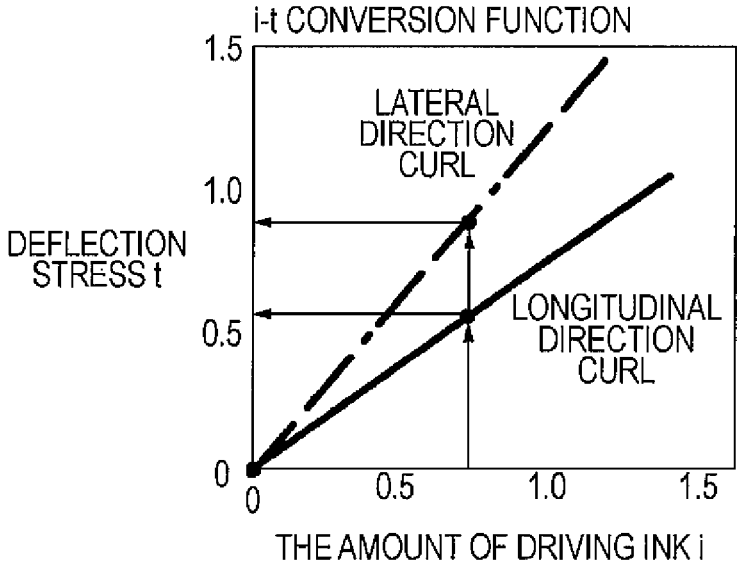
FIG. 9 is a view illustrating a modification of i–t conversion function.

FIG. 9 shows a modification of the i–t conversion function. In the conversion function shown in FIG. 8C, by setting the maximum deflection stress with respect to the longitudinal direction curl to be larger than the maximum deflection stress with respect to the lateral direction curl, when the ink placement amount is large, the phenomenon in which the lateral direction curl is more easily likely to occur than the longitudinal direction curl is reproduced but the invention is not limited thereto. For example, like the conversion function shown in FIG. 9, inclinations of the conversion function (dotted-dashed line) for the lateral direction curl and the conversion function (solid line) for the longitudinal direction curl may be differently set. In FIG. 9, the inclination of the conversion function for the lateral direction curl (inclination with respect to the lateral direction) is set to be larger than the inclination of the conversion function for the longitudinal direction. According to the i–t conversion function, when the ink placement amount is small, the difference between the deflection stress t(x) with respect to the lateral direction curl and the deflection stress t(y) with respect to the longitudinal direction curl is small. On the other hand, when the ink placement amount is large, the difference between the deflection stress t(x) with respect to the lateral direction curl and the deflection stress t(y) with respect to the longitudinal direction curl is large. As a result, it is possible to reproduce the phenomenon in which the lateral direction curl more easily occurs than the longitudinal direction curl when the ink placement amount is large, and therefore it is possible to more precisely predict the curl state of the paper.

In this manner, the deflection stress t(x) with respect to the lateral direction curl and the deflection stress t(y) with respect to the longitudinal direction curl are calculated on the basis of the ink amount placed at each grid section (ink placement amount i→deflection stress t(x), t(y)). Further, after the deflection stress for every grid section of one page of image data is calculated, a subsequent processing is performed.

S004: Smoothed Deflection Stress

Figure 10A:
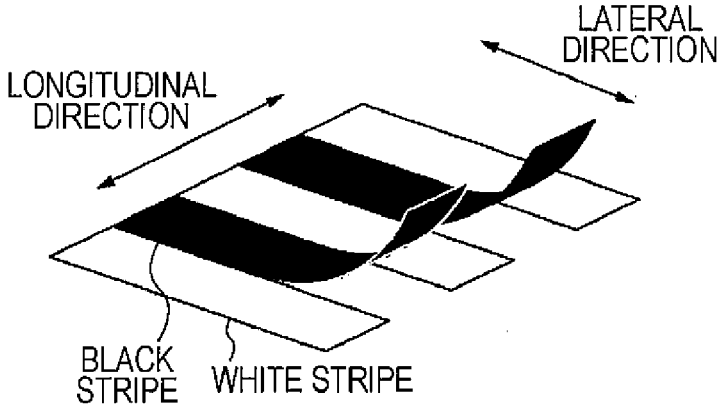
FIG. 10A shows an example in which paper curling is predicted using deflection stress t.
Figure 10B:
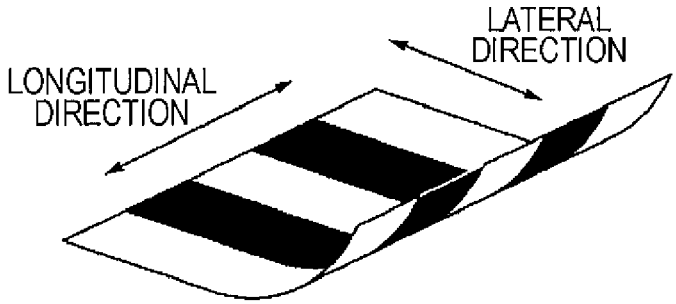
FIG. 10B shows a posture in which paper actually curls.

FIG. 10A shows simulated paper curl using the deflection stress t for every grid section calculated in S003 and FIG. 10B shows actual paper curl. If a lateral stripe is printed on the paper, an area at which ink is placed (black stripe) and an area at which ink is not place (white stripe) are alternately repeated on the paper in the longitudinal direction of the paper. Since the ink placement amount i of grid sections belonging to the white stripe is zero (0), the deflection stress t(x) of the grid sections belonging to the white stripe with respect to the lateral direction curl is also zero (0). For such a reason, it is expected such that the white stripes maintain the paper at flat state rather than causing the paper to curl. On the other hand, since ink is placed at the grid sections belonging to the black stripes, deflection stress t(x) with respect to the lateral direction curl occurs at the grid sections belonging to the black stripes. For such a reason, it is expected such that the black stripes curl in the lateral direction. As a result, if it is predicted such that the paper curls only on the basis of the deflection stress t(x) calculated in S003, as shown in FIG. 10A, the white stripes do not curl but only the black stripes curl in the lateral direction. That is, it is predicted that the paper locally curls in the state in which the paper is separated into the white stripes and the black stripes.

However, since the paper is practically an integrated object, such a curl state in which the white stripes (areas at which ink is not placed) do not curl but only the black stripes (areas at which ink is placed) curl can not be accomplished. In actual practice, as shown in FIG. 10B, the white stripes also are likely to curl because the white stripes are infected by the deflection stress of the black stripes. That is, the paper curling does not intermittently occur, but continuously occurs. For such a reason, it can be known that grid sections around a certain grid section affect the deflection stress t applied to the certain grid section in the case in which deflection stress t occurs with respect to the certain grid section. Accordingly, if the curl state of the paper is predicted only on the basis of the deflection stress t of each grid section calculated in S003, erroneous curl state may be predicted. In greater detail, in the case of the lateral direction curl, the lateral direction curl of a certain grid section is affected by the deflection stress t of grid sections which parallel the certain grid section in the longitudinal direction. Conversely, in the case of the longitudinal direction curl, the longitudinal direction curl of a certain grid section is affected by the deflection stress t of grid sections which parallel the certain grid section in the lateral direction.

In S004, the deflection stress t of a certain grid section is converted to deflection stress T in which the deflection stresses t of neighboring grid sections of the certain grid section are taken into account. That is, the deflection stress of grid sections of the image data corresponding to one page is smoothed (graded with different weights), and the curl state of the paper is predicted on the basis of the graded deflection stress T (herein, referred to as "smoothed deflection stress T"). Further, the deflection stresses t(x) with respect to the lateral direction curl and the deflection stresses t(y) with respect to the longitudinal direction curl are separately smoothed. When smoothing the deflection stresses t(x) with respect to the lateral direction curl, the deflection stresses of grid sections which parallel a target grid section which is to undergo the smoothing processing in the longitudinal direction are more considerably taken into account than the deflection stresses of grid sections which parallel the target grid section which is to undergo the smoothing processing in the lateral direction. Conversely, when smoothing the deflection stresses t(y) with respect to the longitudinal direction curl, the deflection stresses of grid sections which parallel the target grid section which is to undergo the smoothing processing in the longitudinal direction are more considerably taken into account than the deflection stresses of grid sections which parallel the grid section which is to undergo the smoothing processing in the lateral direction.

A calculation expression of the smoothed deflection stress T will be shown below. Here, a direction of the image data which corresponds to the lateral direction of the paper is defined as X direction, and a direction of the image data which corresponds to the longitudinal direction of the paper is defined as Y direction. A coordinate of a grid section in one page of image data is expressed as (i, j). "i" is a position in the X direction (lateral direction) and "j" is a position in the Y direction (longitudinal direction). A coordinate of a grid section (i, j) which is an object of the smoothing processing of the deflection stress t is expressed as (x, y), the calculated smoothed deflection stress is expressed as T(x, y), and a filter coefficient for the smoothing processing is expressed as cnv (i−x, j−y). Further, the smoothed deflection stress T is a dimensionless value.

$$T(x, y) = \sum_i \sum_j cnv(i-x, j-y) \times t(i, j) \qquad \text{Expression 1}$$

That is, the smoothed deflection stress T(x, y) of a target grid section is a value obtained by multiplying the deflection stresses t(i, j) of grid sections around the target grid section and the filter coefficients cnv(i−x, j−y) corresponding to the neighboring grid sections.

Figure 11:
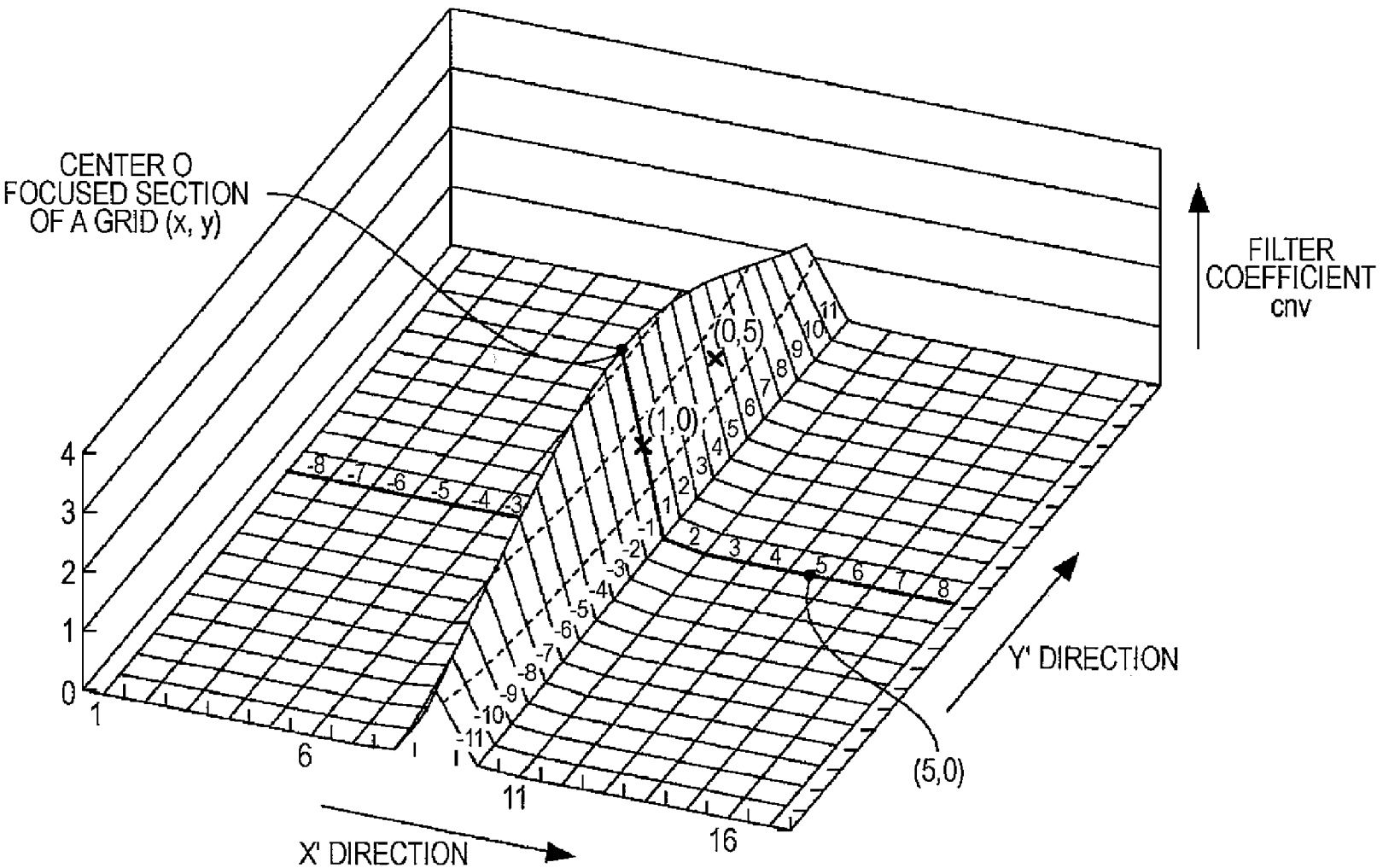
FIG. 11 is a graph illustrating filter coefficient of a lateral direction curl.

FIG. 11 is a graph illustrating the filter coefficient cnv used when calculating the smoothed deflection stress T(x) with respect to the lateral direction curl. Hereinafter, the filter coefficient with respect to the lateral direction curl will be described. A value in an acute-angled direction with respect to an X'-Y' plane is the filter coefficient cnv. A small grid section drawn on the X'-Y' plane corresponds to the grid section defined in the image data in S002, an X' direction corresponds to the X direction (lateral direction), and a Y' direction corresponds to the Y direction (longitudinal direction). When calculating the smoothed deflection stress T(x, y), the coordinate (x, y) of the target grid section is aligned with the center O of the filter coefficient cnv.

The filter coefficient cnv is represented by the following expression (normal distribution). In the filter coefficient cnv (A, B), "A" is distance from the target grid section (center O) in the X direction, and "B" is distance from the target grid section (center O) in the Y direction. "a" is a vignetting width (for example, 5 mm) in the X direction and "b" is a vignetting width (for example, 100 mm) in the Y direction. Each of the vignetting widths "a" and "b" is a standard deviation in normal distribution and means a range in which the deflection stress of the target grid section is considerably affected.

$$cnv(A, B) = \frac{1}{2\pi ab} \cdot e^{-\left(\left(\frac{A^2}{2a^2}\right)+\left(\frac{B^2}{2b^2}\right)\right)}.$$

In the graph of FIG. 11, the filter coefficient cnv (A, B)=cnv (5, 0) of the fifth grid section on the right side of the center O in the X direction is nearly zero (0). Accordingly, when calculating the smoothed deflection stress T (x, y) of the target grid section, the deflection stress t (x+5, y) of the fifth grid section on the right side of the target grid section in the lateral direction is integrated with the value zero. This means that the deflection stress t of the fifth grid section on the right side of the target grid section in the lateral direction does not influence the curl state of the target grid section. Further, at the center of a grid section drawn in the X'-Y' plane in the graph of FIG. 11, a value of the center in the acute-angled direction with respect to the X'-Y' plane is the filter coefficient cnv (1, 0) of the grid section. On the other hand, the filter coefficient cnv (1, 0) of the first grid section on the right side of the center O in the X direction is about 1.5 (average value). Accordingly, when calculating the smoothed deflection stress T(x, y) of the target grid section, a value which is 1.5 times the deflection stress t(x+1, y) of the right side neighboring grid section is integrated. This means that the deflection stress t of the first neighboring grid section on the right side of the target grid section in the lateral direction influences the curl state of the target grid section.

In the expression for calculating the filter coefficient cnv (A, B) with respect to the lateral direction curl, a vignetting width b in the Y direction is larger than a vignetting width a in the X direction. Accordingly, in the graph (FIG. 11) showing the filter coefficient, the value of the filter coefficient of the grid section spaced apart from the center O in the Y' direction is relatively high. For example, the filter coefficient cnv (5, 0) of the fifth grid section on the right side of the center 0 in the X' direction is almost equal to zero (0) but the filter coefficient cnv (0, 5) of the fifth grid section on the upper side of the center O in the Y' direction is about 1.4. According to the graph of FIG. 11, it is known that the smoothed deflection stress T(x) of the target grid section with respect to the lateral direction curl is considerably affected by the deflection stresses t of two grid sections disposed on just the left and right side of the target grid section in the X direction and the deflection stresses of grid sections in a range from the eleventh grid section on the upper side of the target grid section in the Y direction and to the eleventh grid section on the lower side of the target grid section in the Y direction. That is, when smoothing the deflection stress t(x) with respect to the lateral direction curl, the grid sections arranged in the Y direction over a longer length range more considerably affects the smoothed deflection stress T (likeliness of curling) of the target grid section rather than the grid sections arranged in the X direction.

On the other hand, when smoothing the deflection stress t(y) with respect to the longitudinal direction curl, a vignetting width (for example, 100 mm) a of the X direction is set to be larger than a vignetting width b (for example, 5 mm) of the Y direction. As a result, the graph of the filter coefficient of the longitudinal direction curl is a graph which can be obtained by changing the X' direction and the Y' direction of the graph of FIG. 11 which shows the filter coefficient of the lateral direction curl to each other (The filter coefficient of the Y' direction of FIG. 11 is the filter coefficient of the grid section which parallels the target grid section in the lateral direction, and the filter coefficient of the X' direction of FIG. 11 is the filter coefficient of the grid section which parallels the target grid section in the longitudinal direction). Accordingly, it is known that the smoothed deflection stress T(y) of the target grid section with respect to the longitudinal direction curl is more considerably affected by the deflection stresses t of two neighboring grid sections arranged in the Y direction of the target grid section and the deflection stresses of grid sections in a range from the eleventh grid section on the right side of the target grid section in the X direction to the eleventh grid section on the left side of the target grid section in the X direction.

Figure 12A:
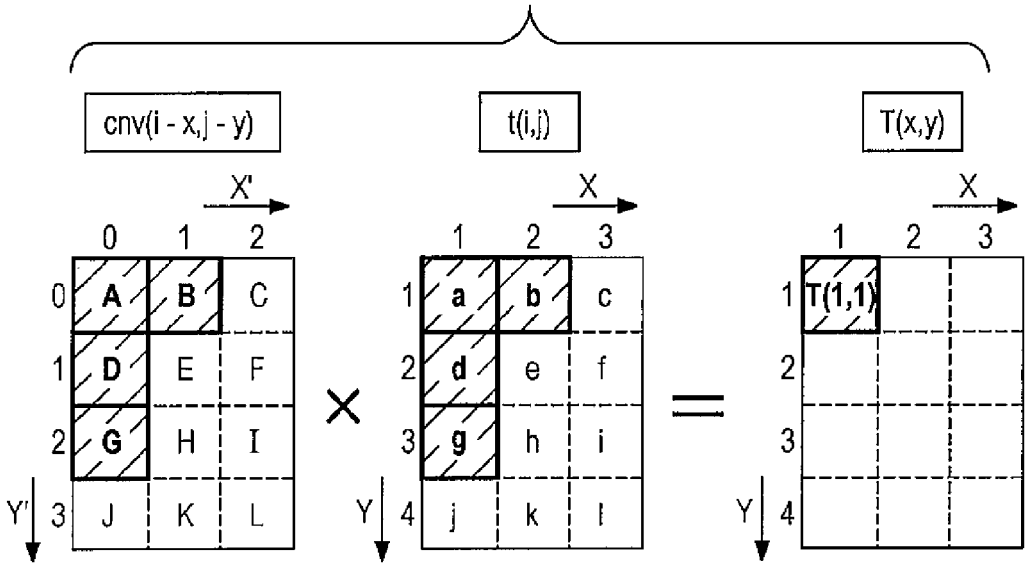
FIG. 12A ad FIG. 12B are concrete examples for calculating smoothed deflection stress.
Figure 12B:
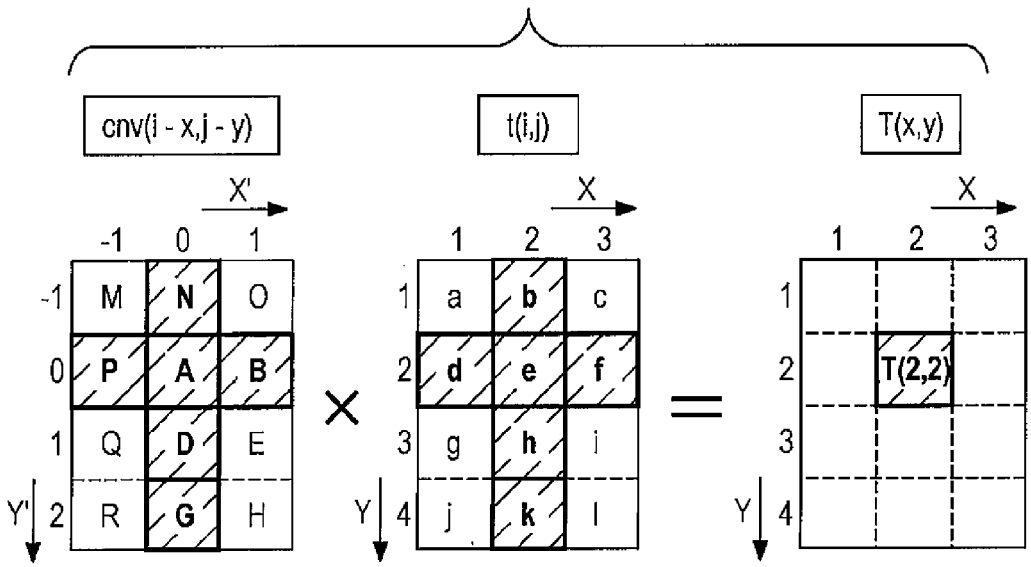

FIGS. 12A and 12B show concrete examples for calculating the smoothed deflection stress T(x) with respect to the lateral direction curl. For convenience's sake of explanation, it is assumed that one page of image data comprises 3×4 grid sections (lateral (X) direction x longitudinal (Y) direction). Of the grid sections constituting one page of image data, a coordinate (i, j) of the upper leftmost grid section is set to (1, 1), the grid sections arranged on the right side of the upper leftmost grid section in the X direction is expressed with (i+1, j) (that is, a value of i is incremented, and the grid sections arranged on the lower side of the upper leftmost grid section in the Y direction is expressed with (i, j+1) (that is, a value of j is incremented). As for the filter coefficient cnv, a value of each of the neighboring grid sections arranged on the left and right sides of the target grid section in the X direction is set to "1," a value of each of two neighboring grid sections arranged on each of the upper and lower sides of the target grid section in the Y direction is set to "1," and a value of each of the other grid sections is set to "0." Further, the filter coefficient corresponding to the coordinate (x, y) of the target grid section corresponds to the center (0, 0).

First, when the upper leftmost grid section (1, 1) is the target grid section and the smoothed deflection stress T(1, 1) is calculated by the above-described Expression 1, the smoothed deflection stress T(1, 1) will be calculated as follows (FIG. 12A):

$$T(1,1)=cnv(0,0)\times t(1,1)+cnv(1,0)\times t(2,1)+cnv(2,0)\times t(3,1)+cnv(0,1)\times t(1,2)+cnv(1,1)\times t(2,2)+cnv(2,1)\times t(3,2)+cnv(0,2)\times t(1,3)+cnv(1,2)\times t(2,3)+cnv(2,2)\times t(3,3)+cnv(0,3)\times t(1,4)+cnv(1,3)\times t(2,4)+cnv(2,3)\times t(3,4)=A\times a+B\times b+C\times c+D\times d+E\times e+F\times f+G\times g+H\times h+I\times i+J\times j+K\times k+L\times 1.$$

A grid section does not exist on the left side of the grid section (1, 1) which is the upper leftmost grid section. Further, a grid section does not exist on the upper side of the grid section (1, 1)(target grid section). Accordingly, the filter coefficients A, B, D, and G=1, and the filter coefficients C, E, F, H, I, J, K, and L=0. For such a reason, the smoothed deflection stress T (1, 1) is expressed by the following expression.

$$T(1,1)=A\times a+B\times b+D\times d+G\times g.$$

In the similar manner, the smoothed deflection stress T (2, 2) of the second uppermost and second leftmost grid section will be calculated (FIG. 12B). The center cnv (0, 0) of the filter coefficient (=A) becomes the filter coefficient corresponding to the target grid section (2, 2). For example, the filter coefficient cnv (1, 0) corresponding to the grid section (3, 2) on the right side of the target grid section becomes B. The smoothed deflection stress T (2, 2) of the target grid section is affected by deflection stresses of one grid section disposed on the upper side of the target grid section in the Y direction, two grid sections on the lower side of the target grid section, one grid section on the left side of the target grid section in the X direction, and one grid section on the right side of the target grid section in the X direction. Accordingly, filter coefficients N, P, A, B, D, and G becomes 1, and the filter coefficients M, O, Q, E, R, H becomes 0. As a result, the smoothed deflection stress T(2, 2) is expressed as follows:

$$T(2,2)=N\times b+P\times d+A\times e+B\times f+D\times h+G\times k.$$

In this manner, the deflection stresses t(x) and t(y) of grid sections of one page of image data are smoothed, and the smoothed deflection stresses T(x) and T(y) are calculated. As a result, it is possible to reproduce a phenomenon in which deflection stresses t of neighboring grid sections are taken into account, and the area (for example, white stripes of FIG. 10) at which the ink placement amount is small is likely to curl along the curling force of neighboring areas (for example, black stripes of FIG. 10) at which the ink is placed. That is, it is possible to predict that curling of the paper continuously occurs, and therefore it is possible to precisely predict the curl state of the paper.

Figure 13:
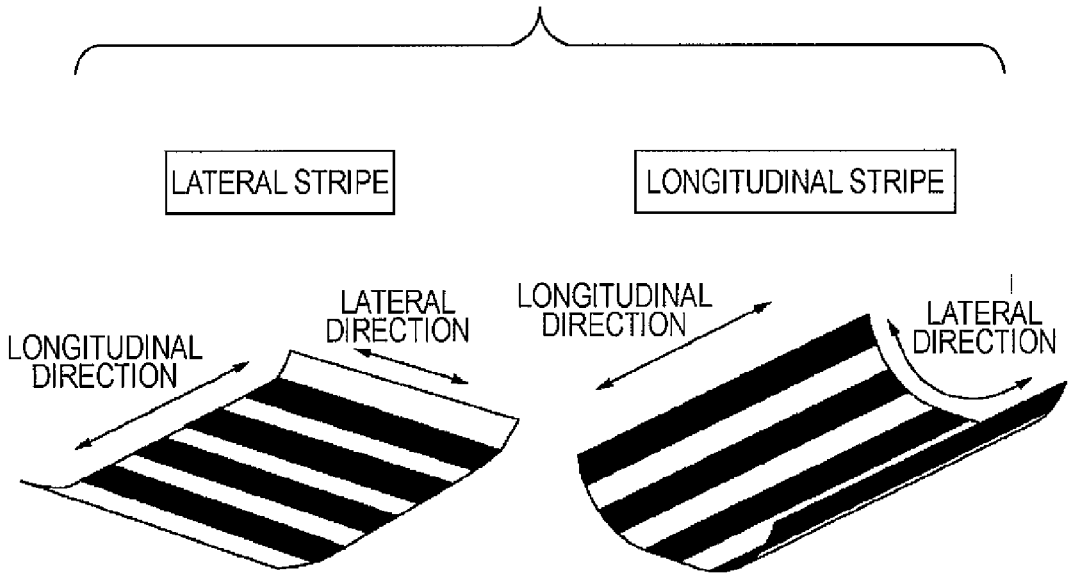
FIG. 13 is a view illustrating difference of curl states of lateral-striped print and longitudinal-striped print.

FIG. 13 shows different curl states in the case in which lateral stripes are printed on paper and in the case in which longitudinal stripes are printed on paper. In the case in which the lateral stripes are printed, the paper easily curls in the longitudinal direction. Conversely, in the case in which the longitudinal stripes are printed, the paper easily curls in the lateral direction. However, since the paper is the most likely to curl in the direction which intersects the direction of the fiber of the paper, with this embodiment, the curl amount of the lateral direction curl of the longitudinal stripe becomes larger than the curl amount of the longitudinal direction curl of the lateral stripe. For example, in the case of printing the lateral stripes, as shown in FIG. 10A, even if the black stripes curl in the lateral direction, since the white stripes adjacent to the black stripe in the longitudinal direction are trying to maintain the flat surface state, the deflection stress with respect to the lateral direction curl is alleviated. On the other hand, in the case of printing the longitudinal stripes, since deflection stresses of the black stripes in the longitudinal direction overlap, the paper gets easily curled in the lateral direction in comparison with the lateral stripes printing. That is, the paper easily gets curled in the direction which intersects a direction in which ink is placed over a relatively long range.

For such a reason, with this embodiment, in the filter coefficient cnv for calculating the smoothed deflection stress T(x) of the lateral direction curl, a vigetting width b of the Y direction is set to be larger than a vigetting width a of the X direction (lateral a<longitudinal b). That is, as shown in the graph of the filter coefficient cnv of FIG. 11, with respect to the target grid section, the grid sections arranged in the longitudinal direction more considerably affects the smoothed deflection stress T(x) with respect to the lateral direction curl of the target grid section rather than the grid sections arranged in the lateral direction over a relatively large area (that is, when the liquid amount of the target grid section changes to the smoothed deflection stress with respect to the lateral direction curl, the liquid amount of the grid sections arranged in the longitudinal direction more considerably affects the smoothed deflection stress T(x) than the liquid amount of the grid sections arranged in the lateral direction). Like the printing of the longitudinal stripes, in the case in which the deflection stresses t of the grid sections arranged in the longitudinal direction of the target grid section are larger, since the deflection stresses t of many grid sections arranged in the longitudinal direction of the target grid section are integrated, a value of the smoothed deflection stress T(x) with respect to the lateral direction curl is increased.

Conversely, in the filter coefficient cnv for calculating the smoothed deflection stress T(y) of the lateral direction curl, a vignetting width a of the X direction is set to be larger than a vignetting width b of the Y direction (lateral a>longitudinal b). That is, the grid sections arranged in the lateral direction of the target grid section affect the smoothed deflection section T(y) with respect to the longitudinal direction curl of the target grid section over a longer range than the grid sections arranged in the longitudinal direction of the target grid section. Accordingly, like the printing of longitudinal stripes, in the case in which the deflection stresses t of the grid sections arranged in the lateral direction of the target grid section are small, a value of the smoothed deflection stress T(y) with respect to the longitudinal direction curl is decreased.

Paper curls in either the lateral direction or the longitudinal direction. Accordingly, like the case of printing longitudinal stripes, a value of the smoothed deflection stress T(x) with respect to the lateral direction curl is larger than a value of the smoothed deflection stress T(y) with respect to the longitudinal direction curl, it is predicted such that the paper is likely to curl in the lateral direction. This supports the phenomenon in which the lateral direction curl more easily occurs in the case of printing longitudinal stripes (in the case in which ink is placed on the paper to extend long in the longitudinal direction).

On the other hand, in the case of printing lateral stripes, ink is placed on the paper to extend in the lateral direction. Accordingly, since the deflection stress t of the neighboring grid sections of the target grid section which parallels in the longitudinal direction is small, the smoothed deflection stress T(x) with respect to the lateral direction curl has a small value. Further, the deflection stresses t of the neighboring grid sections arranged in parallel with the target grid section in the lateral direction are integrated and the smoothed deflection stress T(y) with respect to the longitudinal direction curl has a large value. As a result, as shown in FIG. 13, in the case of printing lateral stripes (in the case in which ink is placed on the paper to extend in the lateral direction), it is predicted such that the paper is likely to curl in the longitudinal direction.

That is, with this embodiment, to reproduce the phenomenon in which the paper is likely to curl in a direction which intersects a direction in which ink is placed over a longer area, in the case of smoothing the deflection stresses t(x) for the lateral direction curl of neighboring grid sections of the target grid section which are arranged in the longitudinal direction is more significantly taken into account than the neighboring grid sections of the target grid section which are arranged in the lateral direction (a<b); and in the case of smoothing the deflection stresses t(y) with respect to the longitudinal direction curl, the neighboring grid sections of the target grid section which are arranged in the lateral direction are more significantly taken in account than the neighboring grid sections of the garget grid section which are arranged in the longitudinal direction (a>b). That is, whether the paper is likely to curl in the lateral direction or whether the paper is likely to curl in the longitudinal direction is determined according to the direction in which the ink is placed. Accordingly, it is possible to more precisely predict the curl state of paper.

Modification of Smoothing of Deflection Stress

Figure 14:
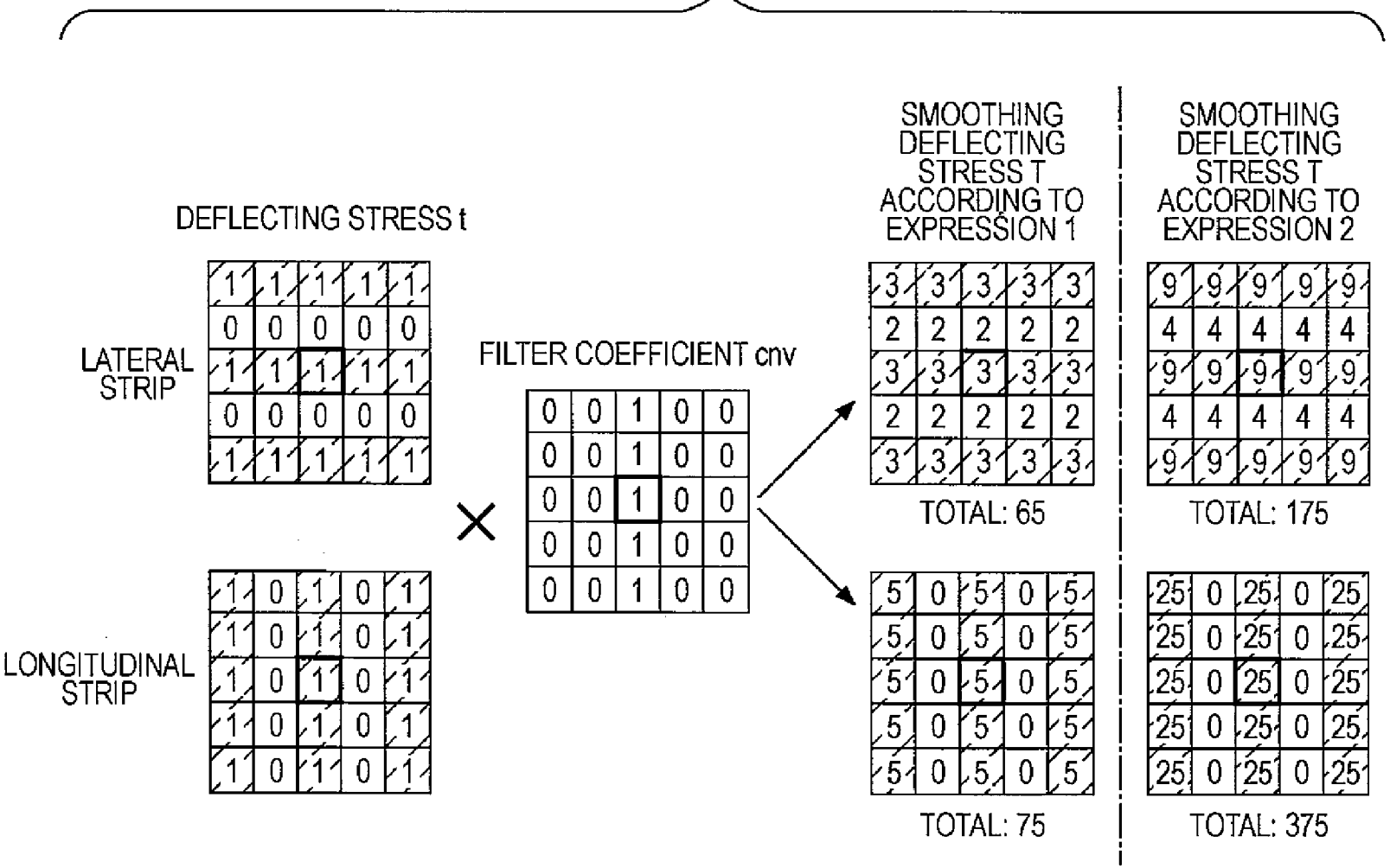
FIG. 14 shows difference of Equation 1 for calculating smoothed deflection stress and Equation 2 which is a modification of an expression for calculating deflection stress.

FIG. 14 shows the difference between the above-described Expression 1 which is a deflection stress smoothing expression and Expression 2 which is a modification of the deflection stress smoothing expression. On the left side of FIG. 14, deflection stresses t of part (5×5 grid sections) of the image data for printing lateral stripes are shown, and deflection stresses t of part of the image data for printing longitudinal stripes are also shown. Also, the difference thereof is shown. The deflection stress t of the grid sections at which ink is placed is set to "1," and the deflection stress of the grid sections at which ink is not placed is set to "0." To calculate the smoothed deflection stress T with respect to the lateral direction curl, it is assumed that two grid sections on each of upper and lower sides of the target grid section which are arranged in the longitudinal direction influences the target grid section. Accordingly, as for the filter coefficient cnv, the filter coefficient cnv of the central target grid section (bold line) and neighboring grid sections arranged in the longitudinal direction is set to "1," and the filter coefficient cnv of the other grid sections is set to "0."

As a result, according to the above-described deflection stress smoothing expression, Expression 1, the smoothed deflection stress T of the target grid section (bold line) which is at the center becomes "3" in the case of printing lateral stripes and "5" in the case of printing longitudinal stripes. In similar manner, the smoothed deflection stresses T of the other grid sections are calculated. As a result, in the case of printing lateral stripes, grid rows, each composing of grid sections arranged in the lateral direction in which deflection stress of each grid section is "3" and grid rows, each composing of grid sections arranged in the lateral direction, in which deflection stress of each grid section is "2," are alternately arranged in the longitudinal direction. On the other hand, in the case of printing longitudinal stripes, grid rows, each composing of grid sections arranged in the longitudinal direction, in which deflection stress of each grid section is "5" and grid rows, each composing of grid sections arranged in the longitudinal direction, in which deflection stress of each grid section is "0," are alternately arranged in the lateral direction.

However, as shown in FIG. 13, in the case of longitudinal-stripe print, the paper is the most likely to curl in the lateral direction in comparison with the case of lateral-stripe print. According to the smoothed deflection stress T with respect to the lateral direction curl which is calculated by Expression 1, the maximum deflection stress of the grid sections with respect to the lateral direction curl with respect to lateral-stripe print is "3," but the maximum deflection stress of the grid sections with respect to the lateral direction curl with respect to longitudinal-stripe print is "5." Accordingly, the phenomenon in which the paper is the most likely to curl in the lateral direction in the case of the longitudinal-stripe print rather than the case of the lateral-stripe print is reproduced. Further, in the case of a grid of 5×5 sections, the sum of the smoothed deflection stresses T with respect to the lateral direction curl is "75" in the case of longitudinal-stripe print and 65 in the case of lateral-stripe print. That is, even for this aspect, the case of longitudinal-stripe print is greater than the case of lateral-stripe print. Accordingly, the phenomenon in which the paper is likely to curl in the lateral direction in the case of longitudinal-stripe print rather than the case of lateral-stripe print is reproduced.

As shown in FIG. 13, as for the amount of curl, the amount of the lateral direction curl in the case of longitudinal-stripe print is larger than the amount of the longitudinal direction curl in the case of lateral-stripe print. Accordingly, in order to more strongly support and reproduce the phenomenon in which the lateral direction curl more easily occurs in the longitudinal-stripe print than the lateral-stripe print, the deflection stresses may be smoothed using the following Expression 2.

$$T(x, y) = \left\{ \sum_i \sum_j cnv(i-x, j-y) \times t(i, j)^{\frac{1}{\gamma}} \right\}^{\gamma} \quad \text{Expression 2}$$

According to the modification, Expression 2, a value of 1/γ-th power of the deflection stress t which is not yet smoothed is multiplied by the corresponding filter coefficient cnv, and than the resultant value is integrated. After that, a γ-th power of the resultant value of the integration is obtained. γ is a value larger than 1.

With this embodiment, in a calculation expression of the filter coefficient cnv for the lateral direction curl, a vignetting width b of the longitudinal direction is set to be larger than a vignetting width a of the lateral direction. Accordingly, in the case of performing the longitudinal-stripe printing, the smoothed deflection stress T of the stripe, in which ink is placed, with respect to the lateral direction curl is increased, the smoothed deflection stress T of the strip in which ink is not placed, with respect to the lateral direction curl is decreased, and the difference between the smoothed deflection stresses T of the ink-present-stripe and the ink-absent stripe is large. On the other hand, in the case of performing the lateral-stripe printing, the difference between the deflection stresses with respect to the lateral direction curl of the ink-present stripe and the ink-absent stripe is small. For such a reason, the ink-present grid sections of the longitudinal-stripe print are larger than the ink-present grid sections of the lateral stripe print in a value obtained by multiplying the filter coefficient cnv by the deflection stress t and then integrating the resultant value of the multiplication. Accordingly, it is possible to increase the difference of deflection stresses with respect to the lateral direction curl of the lateral-stripe print and the longitudinal-stripe print by raising the value obtained by multiplying the filter coefficient cnv and the 1/γ-th power of the deflection stress t and then integrating the resultant value of the multiplication to the r-th power.

In FIG. 14, the result of the smoothed deflection stress T calculated using Expression 2 in which highlighting coefficient γ=2 is shown. The smoothed deflection stress T of the ink-present grid sections in the lateral-stripe print is 9 and the smoothed deflection stress T of the ink-present grid sections in the longitudinal-stripe print is 25. The sum of the smoothed deflection stresses T of a 5×5 grid is 375 in the case of longitudinal-stripe print and is larger than the sum, 175, in the case of lateral-stripe print. Accordingly, when calculating the smoothed deflection stresses with respect to the lateral direction curl, it is possible to strongly support and reproduce the phenomenon in which the longitudinal-stripe print is more likely to cause the lateral direction curl than the lateral-stripe print by using Expression 2. Further, even when calculating the smoothed deflection stresses with respect to the longitudinal direction curl, it is possible to strongly support and reproduce the phenomenon in which the lateral-stripe print is more likely to cause the longitudinal direction curl than the longitudinal-stripe print by using Expression 2.

S005: Calculation of Gravitational Moment

Paper has a weight. Accordingly, there is force which is trying to suppress curling of the paper by the weight of the paper, resisting against the force causing the paper to curl, which is attributable to the deflection stress generated when ink is placed on the paper. However, as shown in FIG. 5B, the paper is more likely to curl when ink is discharged to an end portion of the paper than when ink is discharged to the center of the paper because the deflection stress must be stronger than the curling suppression force attributable to the weight of part of the paper, which ranges from the center of the paper to the end portion of the paper, when causing the center portion of the paper to curl. Accordingly, although the same amount of ink is placed on the paper, it is harder to cause the center portion of the paper to curl than to cause the end portion of the paper to curl.

In S005, curling suppression force attributable to the weight of part of the paper, the part ranging from a certain grid section to the end portion of the paper, is calculated for every grid section. The curling suppression force is calculated using a certain grid section (target grid section) as a base section by integrating moment forces which are generated by the weights of the grid sections disposed and disposed between a certain grid section to the end portion of the paper. Hereinafter, the curling suppression force is referred to as gravitational moment G. Further, in a next step S006, the curl state of the paper is predicted from the difference between the smoothed deflection stress T and the gravitational moment G.

Figure 15A:
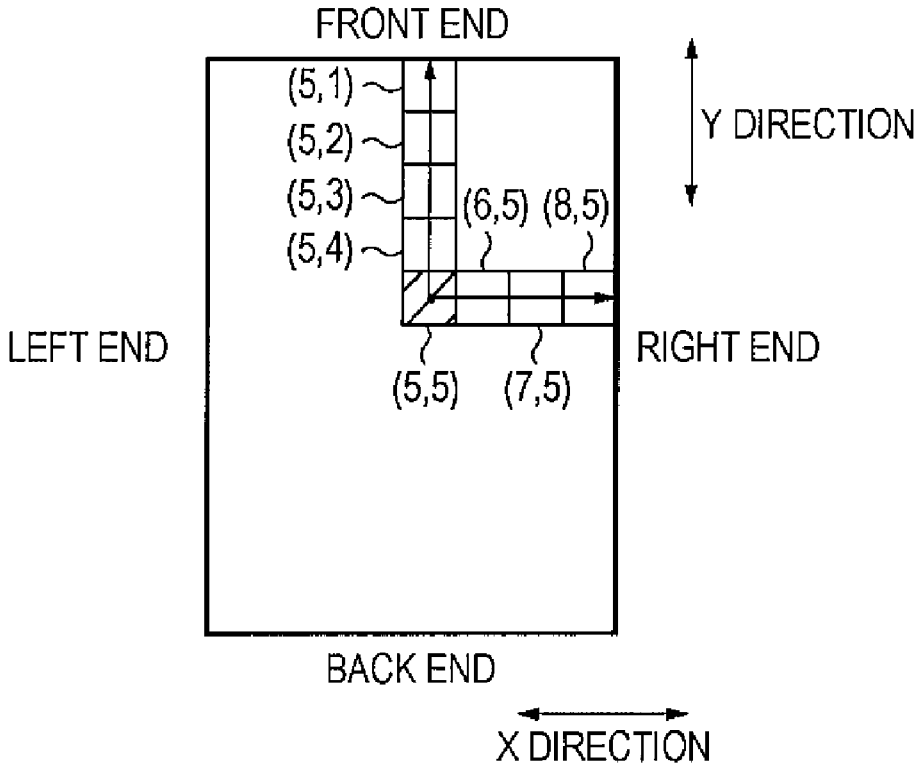
FIG. 15A is a view illustrating grid sections of a grid ranging from a target section to a section at the edge of paper and FIG. 15B shows an example of calculating gravitational moment of a single grid section of a grid.
Figure 15B:
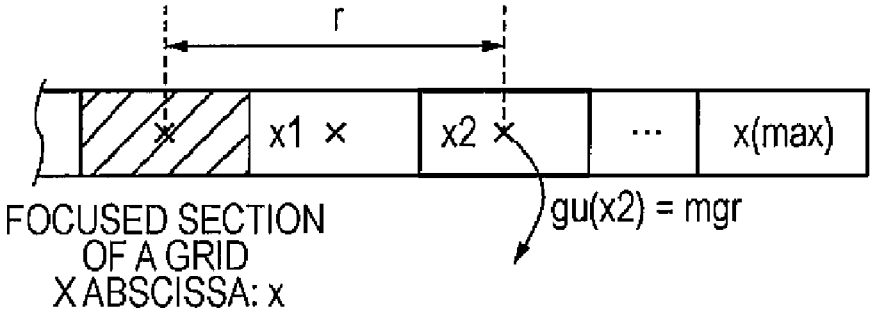

FIG. 15A is a view illustrating grid sections disposed between the target grid section (shaded area) and the end portion of the paper. FIG. 15B is a view illustrating calculation of the gravitational moment gu of one grid section. First, moment force (hereinafter, referred to as unit gravitational moment gu) which is generated by the weight of each of the grid sections provided between the target grid section and the end portion of the paper is calculated for every grid section around the target grid section. Next, the unit gravitational moments gu of the grid sections provided between the target grid section and the end portion of the paper are integrated to calculate the gravitational moment G. However, there are four ends in the paper but the direction in which the paper curls is two kinds (lateral direction curl and longitudinal direction curl). Accordingly, as for a single target grid section, the gravitational moment G(x) with respect to the lateral direction curl and the gravitational moment G(y) with respect to the longitudinal direction curl are calculated. The gravitational moment G(x) with respect to the lateral direction curl is a value obtained by integrating unit gravitational moments gu(x) of grid sections which are arranged on one side of a target grid section in the X direction and provided between an end of the paper, which is either a left end or a right end and is nearer the target grid section, and the target grid section. The gravitational moment G(y) with respect to the longitudinal direction curl is a value obtained by integrating unit gravitational moments gu(y) of grid sections which are arranged on one side of the garget grid section in the Y direction and provided between an end of the paper, which is either the front end or the back end and is nearer the target grid section, and the garget grid section.

Hereinafter, a calculation expression of the gravitational moment G(x) with respect to the lateral direction curl is described. Further, a calculation expression of the gravitational moment G(y) with respect to the longitudinal direction curl is similar to that. m is a weight of a single grid section (for example, 64 g/m$^2$), g is gravity acceleration (for example, 9.8 m/s$^2$), X is a coordinate position of the target grid section, Xmax is a coordinate position of a grid section which is the nearest grid section of the end of the paper, and r is distance between the target grid section and a grid section used for calculating the unit gravitational moment gu. The gravitational moment when the paper is in a flat state is G, and the gravitational moment G is a dimensionless value like the smoothed deflection stress T.

$$G(x) = \sum_{r=1}^{x\ max-x} (mg)\cdot r$$

The unit gravitational moment gu(x) of a single grid section is expressed as "gu(x)=mgr." FIG. 15B shows calculation of the unit gravitational moment gu(x2) of the second grid section x2 on the right side of the target grid section. The mass of the grid section x2 is m, the gravity exerted on the grid section x2 is g, the distance between the target grid section and the grid section x2 is r. Accordingly, moment force (unit gravitational moment gu (x2)) of the grid section x2 around the target grid section is mgr.

For example, it is assumed that an XY coordinate of the target grid section (shaded area of FIG. 15A) is (5, 5). It is further assumed that the target grid section is near the right end of the paper in the X direction rather than the left end of the paper. In such a case, the gravitational moment G(x) of the target grid section with respect to the lateral direction curl is an integrated value of unit gravitational moments gu of three grid sections (6, 5), (7, 5), and (8, 5) which are provided between the target grid section and the right end of the paper. It is still further assumed that the target grid section is nearer the front end of the paper than the back end of the paper in the Y direction. In this case, the gravitational moment G(y) of the target grid section with respect to the longitudinal direction curl is an integrated value of unit gravitational moments gu of four grid sections (5, 1), (5, 2), (5, 3), and (5, 4) provided between the target grid section and the front end of the paper.

Figure 16A:
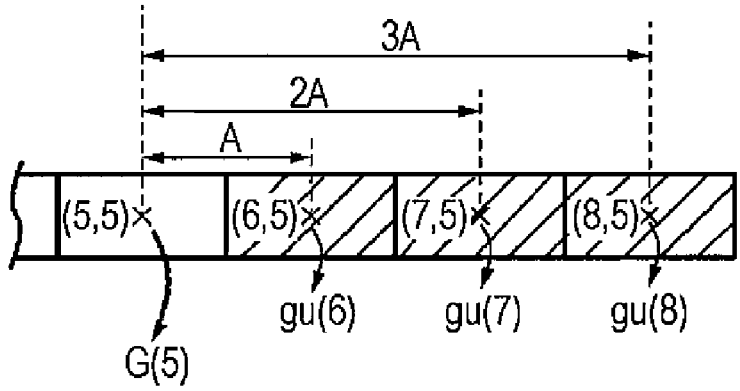
FIG. 16A, FIG. 16B, and FIG. 16C show examples of calculating gravitational moments with respect to a lateral direction curl.

FIG. 16A shows calculation of the gravitational moment G(5) of a grid section (5, 5) with respect to the lateral direction curl. The gravitational moment G(5) of the target grid section (5, 5) is an integrated value of the unit gravitational moment gu(6) of a grid section (6, 5), the unit gravitational moment gu(7) of a grid section (7, 5), and the unit gravitational moment gu(8) of a grid section (8, 5). Further, it is assumed that the length of the grid section in the lateral direction is A, and distance between adjacent grid sections is also A. As a result, the gravitational moment G(5) will be expressed as follows:

$$G(x)=G(5)=gu(6)+gu(7)+gu(8)=\text{mgA}+2\ \text{mgA}+3\ \text{mgA}=6\ \text{mgA}$$

Figure 16B:
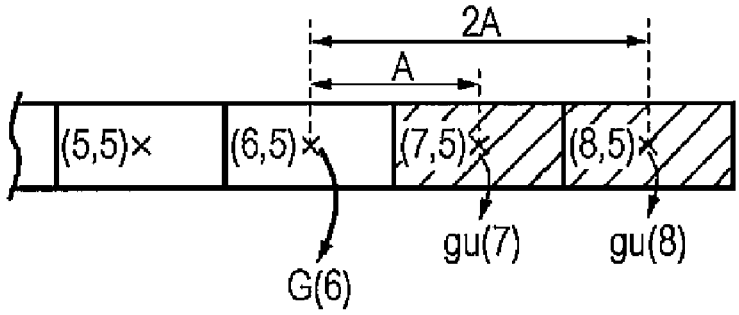
Figure 16C:
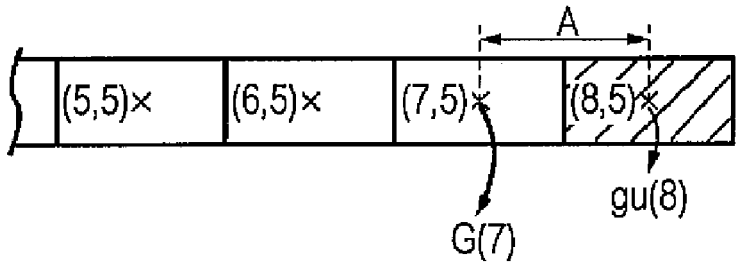

FIG. 16B shows calculation of the gravitational moment G(6) of a grid section (6, 5) with respect to the lateral direction curl. FIG. 16C shows calculation of the gravitational moment G(5) of a grid section (7, 5) with respect to the lateral direction curl. In a similar manner, the gravitational moment G(6) of a grid section (6, 5) and the gravitational moment G(7) of a grid section (7, 5) will be expressed as follows:

$$G(x)=G(6)=gu(7)+gu(8)=\text{mgA}+2\ \text{mgA}=3\ \text{mgA}$$

$$G(x)=G(7)=gu(8)=\text{mgA}$$

As a result from the above, the gravitational moment of a grid section which is near a center portion of the paper (for example, G(5)=6 mgA) is larger than the gravitational moment of a grid section which is near an end portion of the paper (for example, G(7)=mgA). Accordingly, as the grid section becomes nearer the center portion of the paper, the smoothed deflection stress T prevails against the gravitational moment G, and therefore the paper is not likely to curl. That is, it is possible to reproduce the phenomenon in which a portion of the paper which is nearer the center portion is not likely to curl in comparison with a portion of the paper which is nearer the end portion, and it is possible to more precisely predict occurrence of the paper curling.

After the gravitational moment G(x) of each of grid sections with respect to the lateral direction curl and the gravitational moment G(y) of each of grid sections with respect to the longitudinal direction curl are calculated, a next step is performed. When a target grid section is positioned at the center portion of the paper, and the distance from the center of the grid section to the left end (front end) of the paper and the distance from the center of the grid section to the right end (back end) of the paper are equal to each other, the gravitational moment of the target grid section is calculated by integrating unit gravitational moments gu of grid sections provided between the grid section disposed at the center of the paper to either the left end (front end) or the right end (back end).

S006: Calculation of Curl Amount for Every Grid Section

So far, the prediction processing software has calculated the deflection stresses t(x) and t(y) with respect to the lateral direction curl and the longitudinal direction curl, respectively on the basis of ink amount i placed on grid sections, and then calculated the smoothed deflection stresses T(x) and T(y) while taking the deflection stresses of neighboring grid sections into account. The gravitational moments G(x) and G(y) with respect to the lateral direction curl and the longitudinal direction curl, respectively are calculated for every grid section. On the basis of these values, a curl angle θ and a curl amount Z, in which each of the curl angle θ and the curl amount Z corresponds to the amount of curl, are calculated.

Figure 17A:
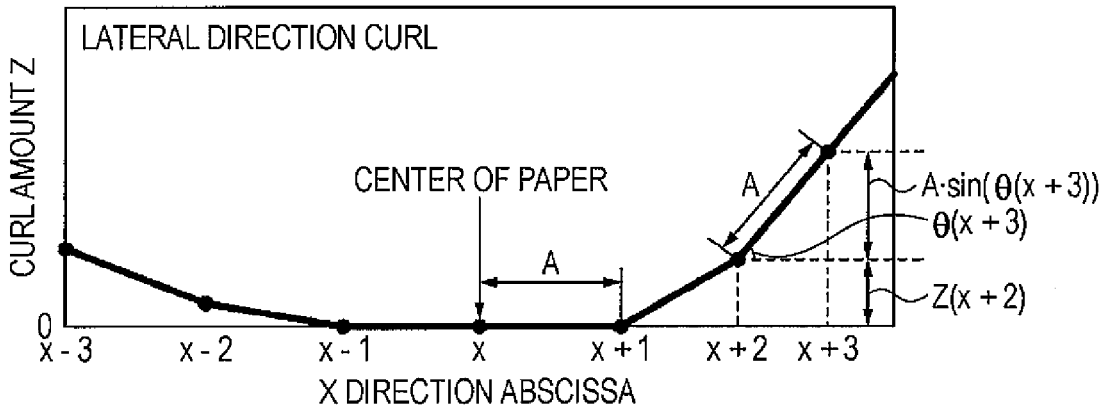
FIG. 17A is a view illustrating a curl angle and a degree of curl (curl amount).
Figure 17B:
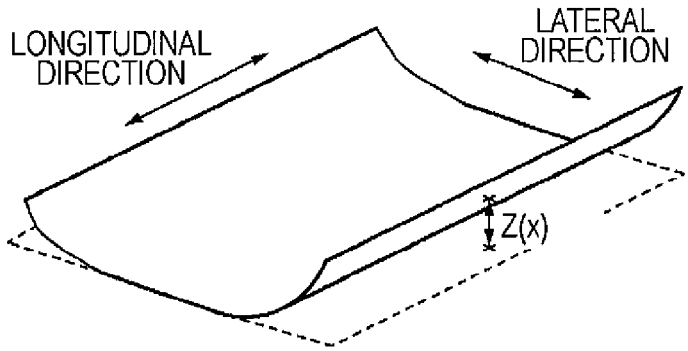
FIG. 17B is a perspective view illustrating a degree of curl (curl amount).

FIG. 17A is a view illustrating the curl angle θ(x) and the curl amount Z(x) of each grid section with respect to the lateral direction curl, and FIG. 17B is a perspective view illustrating the curl amount Z(x). The smoothed deflection stress T is force of trying to cause the paper to curl, and the gravitational moment is force of suppressing the paper curling. For such a reason, the curl angle θ of the paper is calculated from the difference between the basis of the smoothed deflection stress T and the gravitational moment G. When the coordinate of the target grid section is (x, y), the curl angle θ(x) with respect to the lateral direction curl is shown by an expression below. The curl angle θ(y) with respect to the longitudinal direction curl is also expressed by the similar expression. α is a conversion coefficient used for changing force of the difference between the smoothed deflection stress T(x) and the gravitational moment G(x) to the curl angle θ(x), and is calculated by experience (experiment).

$$\theta(x)=\theta(x-1)+(T(x)-G(x))\cdot\alpha$$

With this embodiment, since the curl in which the printed surface becomes the inside surface is considered, in the case the difference (T(x)−G(x)) becomes a negative value for some reasons, for example the amount of ink placed on the paper is small and the smoothed deflection stress T(x) is small, or for example the target grid section is disposed near the center portion of the paper and therefore the gravitational moment G(x) is high, the curl angle θ(x) is set to zero (0) which means the paper does not curl. θ(x−1) is the curl angle of a grid section (x−1) adjacent to the target grid section and disposed nearer the center portion of the paper than the target grid section (x).

After the curl angle θ(x) is calculated for every grid section, the curl amount Z(x) can be calculated. The curl amount Z(x) is a vertical length of the paper when the flat surface of the paper is horizontally aligned. A calculation expression of the curl amount Z(x) of the lateral direction curl will be shown below. "A" is a length of a grid section in the X direction. The curl amount Z(y) of the longitudinal direction curl also can be calculated in a similar manner. Z(x−1) is the curl amount of a grid section (x−1) disposed adjacent to the target grid section (x) and nearer the center portion of the paper than the target grid section.

$$Z(x)=Z(x-1)+A\cdot\sin\theta(x)$$

As described above, as the target grid section is nearer the center portion of the paper, the paper is not likely to curl. Further, the curl of the paper is continuous. Accordingly, with this embodiment, the center portion of the paper serves as a base, and the curl angles θ and the curl amounts z of grid sections are integrated in sequence order from a grid section provided at the center portion of the paper toward a grid section provided at each of four end portions (left end, right end, front end, and back end) of the paper. Accordingly, in the calculation expression of the curl angle θ(x), the curl angle θ(x−1) of a grid section adjacent to the target grid section and nearer the center portion of the paper then the target grid section is added to the curl angle θ(x) attributable to force which causes the target grid section to curl. In the calculation expression of the curl amount Z(x), the curl amount Z(x−1) of a grid section adjacent to the target grid section and nearer the center portion of the paper than the target grid section is added to the curl amount Z(x) attributable to force which causes the target grid section to curl.

In greater detail, the curl amount Z and curl angle θ of a grid section corresponding to the center of the paper is set to zero (0) (predetermined value) in order to make the center of the paper a base, and curl amounts and curl angles of grid sections arranged in parallel with the target grid section are sequentially integrated in order from the grid section at the center of the paper to the grid section at one end of the paper. As for the lateral direction curl, a grid section adjacent to the center of the paper in the lateral direction (referred to as "center-positioned grid section") becomes a base, the curl amounts and the curl angles of the grid sections arranged in parallel with the center-positioned grid section are integrated in sequence order from the center-positioned grid section to the grid section at the left end or the right end of the paper. In FIG. 17A, the curl angle θ(x+1) of the adjacent grid section (x+1) on the right side of the center-positioned grid section is zero (0), and the curl amount Z(x+1) of the grid section (z+1) also becomes zero (0). At the grid section (x+3) farther from the center-positioned grid section than the grid section (x+1), the paper curling occurs at the curl angle θ (x+3). The curl amount Z(x+3) of the grid section (x+3) is a length obtained by adding [the curl amount Z(x+2) of the grid section (x+2)] to [the curl amount A×sin θ(x+3) attributable to the curl angle θ(x+3) of the grid section (x+3)]. That is, the grid section (x+3) curls by the amount of Z(x+3) from the flat surface. In this manner, it is possible to predict how much amount of curl occurs at which position.

As for the longitudinal direction curl, the center portion of the paper serves as a base, and the curl amounts of grid sections arranged in parallel with the base in the longitudinal direction are integrated in sequence order from the base to the front end or the back end of the paper. As for the XY coordinate of the grid section shown when calculating the smoothed deflection stress T (S400), the left uppermost grid section is the base (1, 1). In this case, when calculating the curl angle θ(x) and curl amount Z(x) of the left side grid section or the upper side grid section of the center of the paper, the curl angle θ(x+1) and the curl amount Z(x+1) of the grid section having an incremented coordinate become reference values.

Figure 17C:
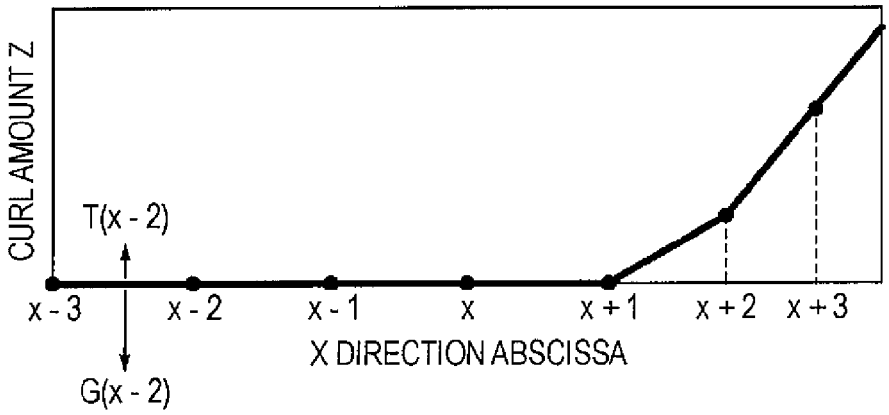
FIG. 17C is a view illustrating a curl angle and a degree of curl (curl amount) according to a comparative example.

FIG. 17C is a comparative example and shows the curl angle and the curl amount when the left side end of the paper is a base. With the embodiment, the gravitational moment G, the curl angle θ, and the curl amount Z are calculated, setting the center portion of the paper as a base in order to reproduce the phenomenon in which it is harder for the center portion of the paper to curl than for an end portion of the paper. In the case in which the gravitational moment G, the curl angle θ, and the curl amount Z are calculated, setting a left end portion of the paper as the base instead of setting the center portion of the paper as the base, the gravitational moment G'(x−2) of a side grid section (for example, grid section (x−2)) disposed on the left side of the center portion of the paper becomes an integrated value of unit gravitational moments gu(x) of grid sections ranging from the grid section (x−2) to a grid section at the right end of the paper. That is, the gravitational moment G' of a grid section provided at relatively left side is larger than an integrated value of unit gravitational moments gu of grid sections provided at a right side of the paper and is actually too much larger than the force (gravitational moment) which suppresses paper curling. As a result, the gravitational moment G' becomes too much larger than the smoothed deflection stress T. Therefore, as shown in FIG. 17C, it is predicted such that all of the grid sections provided on the relatively left side of the paper never curl. For such a reason, in the embodiment, since the gravitational moment G, the curl angle θ, and the curl amount Z are calculated by making the center portion as a base by considering the phenomenon in which it is harder, for the center portion of the paper to curl than for the end portion of the paper, it is more precisely predict the curl state of paper.

Figure 17D:
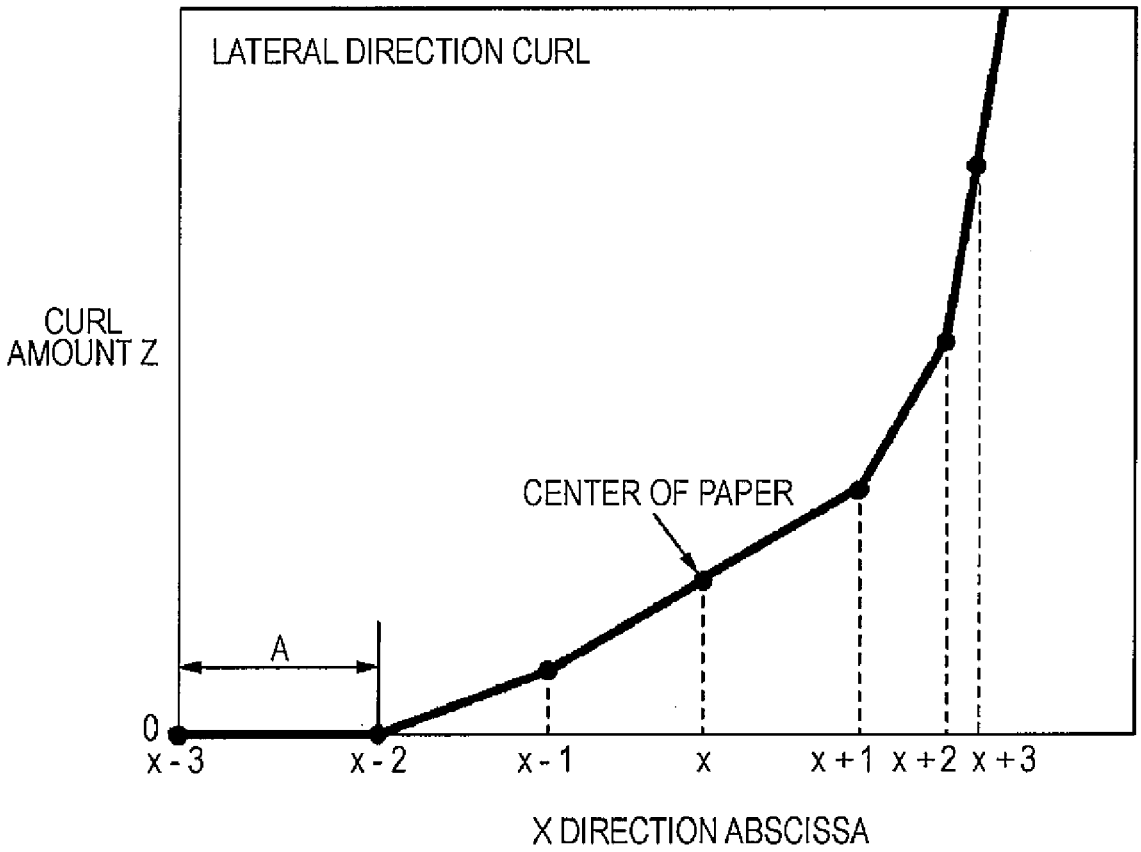
FIG. 17D is a view illustrating a curl angle and a degree of curl (curl amount) according to another comparative example.

FIG. 17D is another comparative example and shows curl angles θ and curl amounts Z when a left side end portion of the paper is a base. In this comparative example, the gravitational moment G is calculated setting the center portion of the paper as a base but the curl angle θ and the curl amount Z are calculated setting the left side end portion as a base. Accordingly, as shown in the above-mentioned comparative example (FIG. 17C), the gravitational moment G of the grid section of the left side end portion of the paper is too much larger than that of the center portion of the paper. In even the case in which the curling occurs, it is possible to prevent erroneous prediction in which the left side end portion of the paper never curls from being made. However, if integration of the curl angles θ and the curl amount Z is started from the left side end portion of the paper, an integrated value of the curl amounts occurring at grid sections provided from the left side end portion to the center portion of the paper is predicted as the curl amount of the center portion of the paper. This contradicts the phenomenon in which it is harder for the center portion of the paper to curl than for the end portion of the paper. Further, at a right side end portion of the paper, since the curl amounts of the grid sections ranging from the left side end portion of the paper to the right side end portion of the paper are integrated, it is predicted such that much larger amount of curl than the actual curl amount occurs. In such a case, although the actual curl amount of the right side end portion of the paper is a value not larger than the threshold value when a degree of curl predicted in a subsequent step is compared with a threshold value, it is predicted such that the curl amount is larger than the threshold value. As a result, unnecessary anti-curling measurement is likely to be performed. For such a reason, as in the embodiment, not only when calculating the gravitational moment G but also when calculating the curl angle θ and the curl amount Z, since the center portion of the paper serves as a base, it is possible to more precisely predict the curl state of the paper.

S007: Prediction of a Paper Curl State

Finally, the curl amount Z(x) with respect to the lateral direction curl and the curl amount Z(y) with respect to the longitudinal direction curl are compared for every grid section, and a larger curl amount z is adopted as the curl amount Z of the corresponding grid section.

Figure 18A:
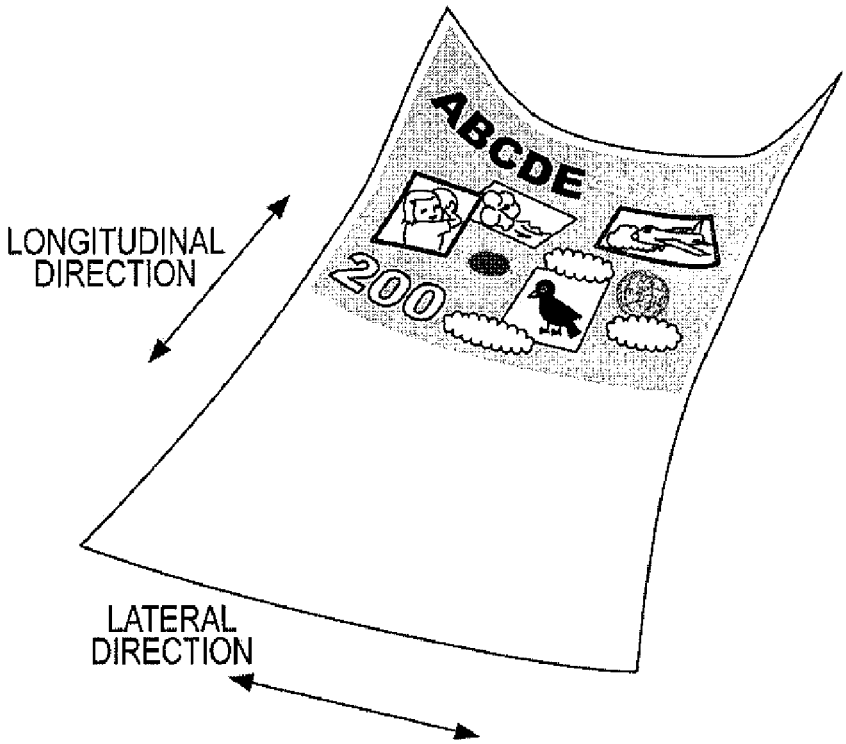
FIG. 18A is a view illustrating a curl state of paper in which an image is printed in an upper half portion of the paper in the longitudinal direction and FIG. 18B is a graph illustrating calculated curl amount Z.
Figure 18B:
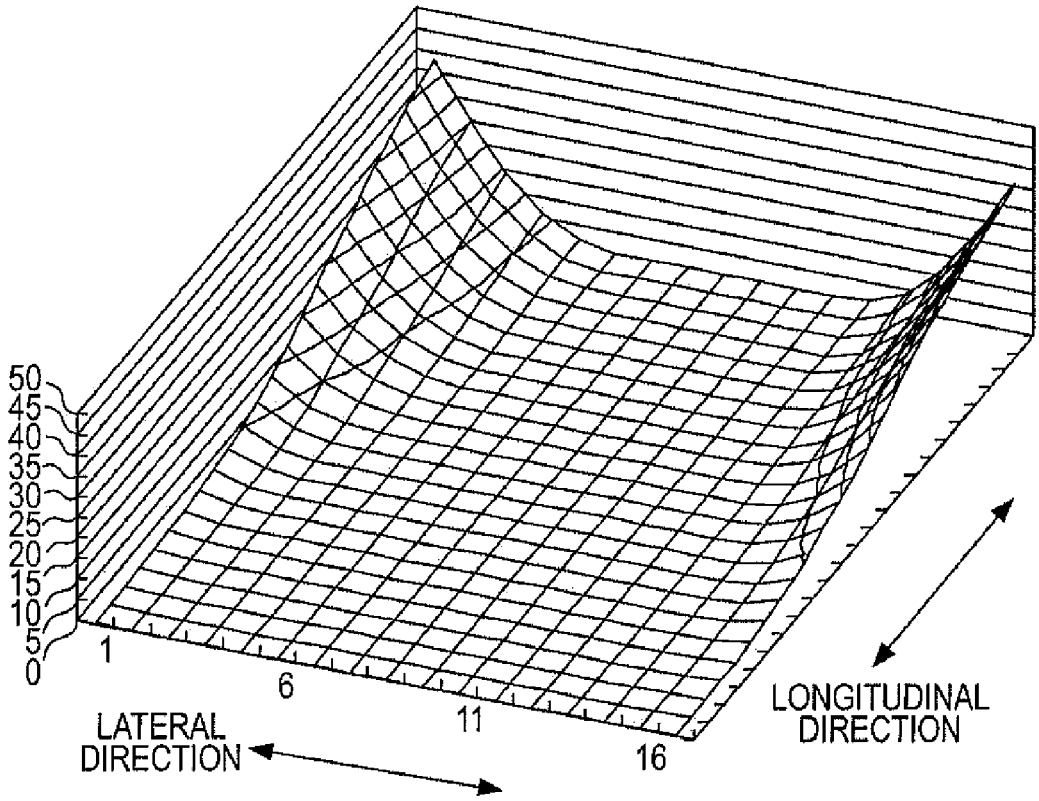

FIG. 18A shows a curl state of the paper in which an image (photographed image) is printed at an upper half part of the paper. FIG. 18B is a view illustrating a three-dimensional graph of curl amounts Z calculated by a curl predicting processing program. If an image is actually printed only at the upper half part of the paper, the left upper portion and the right upper portion of the paper laterally curl. In the result (FIG. 18B) predicted by the curl predicting processing program, the lateral direction curl occurs at the left upper portion and the right upper portion, and it is possible to precisely predict the curl state (curl position and curl amount).

About Anti-Curling Measurement

Figure 19:
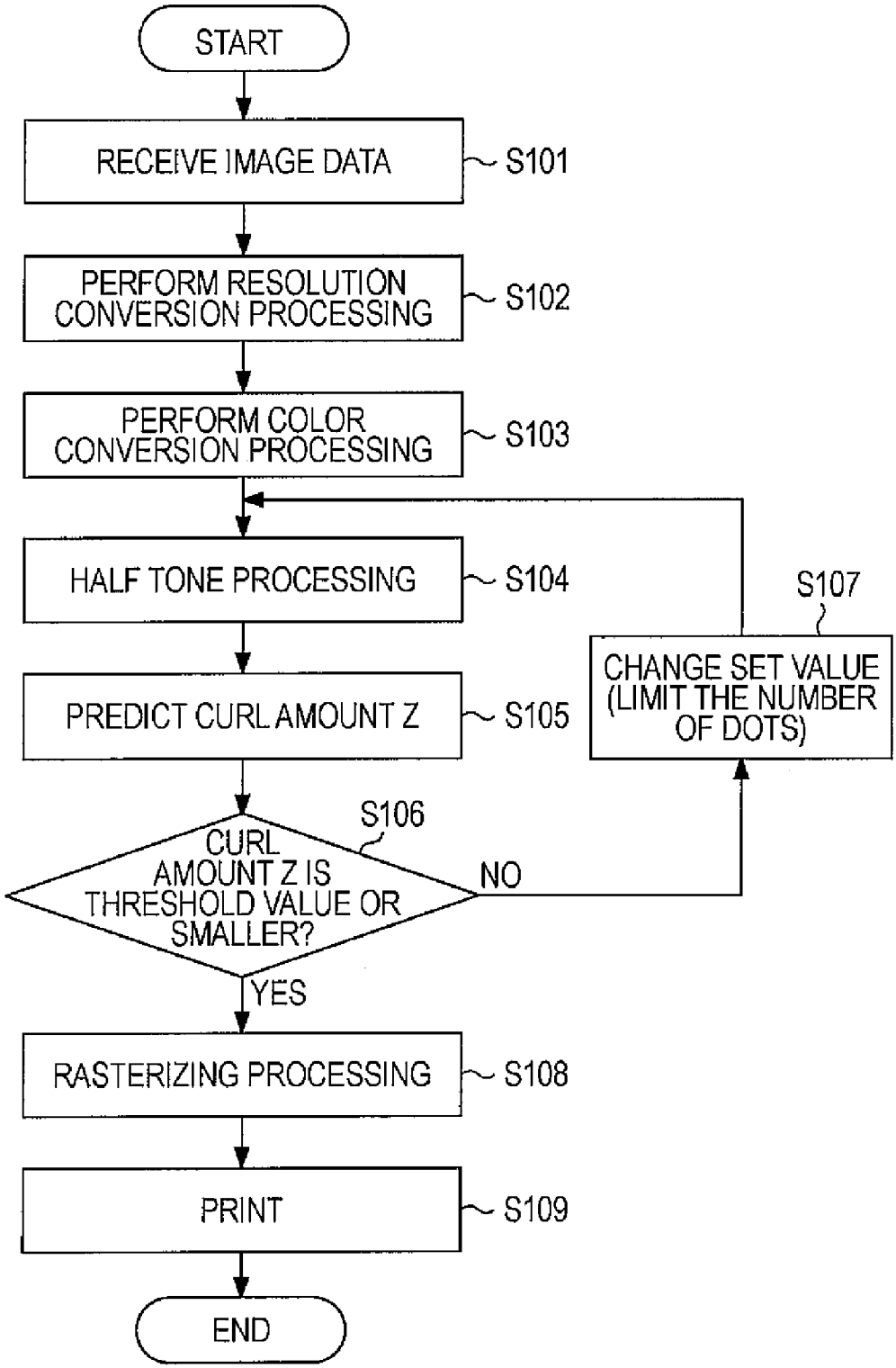
FIG. 19 shows flow of anti-curling processing.

FIG. 19 shows flow of a anti-curling measurement. In the case in which the curl amount Z of each grid section predicted by the above-mentioned curl predicting method is equal to or larger than the threshold value (that is, if the curl amount of a single grid section is equal to or larger than the threshold voltage), the anti-curling measurement is performed. With this embodiment, the paper curling is prevented by limiting the ink placement amount.

According to the flow shown in FIG. 19, when the printer driver receives the image from application software (S101), the printer driver performs resolution conversion processing (S102), color conversion processing (S103), and half tone processing (S104), and produces the image data (data illustrating presence and absence of dots for pixels). After that, the printer driver sends the image data to a curl predicting processing program and lets the curl predicting processing program predict the curl amount Z (S105). The printer driver changes a set value of the half tone processing so that the ink placement amount is decreased (S107) in the case in which the calculated curl amount Z is not smaller than the threshold value (NO: S106), and then performs the half tone processing again. For example, dot forming rate may be decreased so that the ink placement amount is decreased (S107). When the recalculated curl amount Z is equal to or smaller than the threshold value (YES: S106) on the basis of the image data in which the ink placement amount id decreased, the printer driver performs rasterizing processing and sends print data to the printer 1. As a result, it is hard for the paper on which the printer 1 performs printing to curl (S109).

In this manner, the curl state of the paper is predicted on the basis of distribution of ink as well as the ink amount placed on the paper by the curl predicting processing program and the anti-curling measurement is performed only when it is predicted that the paper curls. Accordingly, it is possible to more securely prevent the paper from curling. Conversely, when it is predicted that the paper does not curl, it is unnecessary to perform the anti-curling measurement and therefore it is possible to shorten the printing processing time. Further, it is possible to prevent image quality from deteriorating which is likely attributable to the decrease in the ink placement amount.

The anti-curling measurement is not limited to the decrease of the ink placement amount but other methods may be used. For example, when the curl amount Z is equal to or larger than the threshold value, it is possible to lengthen heat emission time of a heater in the case in which the printer is equipped with a heater for drying ink after printing or it is possible to lengthen the anti-curling time in the case in which the printer is provided with a mechanism of suppressing paper-curling. Further, it is possible to increase a coating amount of an anti-curling agent in the case in which the printer is a printer which applies the anti-curling agent (for example, water) to an area other than the printed image area.

Other Embodiments

In the above-mentioned embodiments, description is made mostly focusing on the printing system equipped with an ink-jet printer, but the description includes disclosure of the curl predicting method. The above-mentioned embodiments are provided only for the purpose of helping ones better understand invention and must not be construed in a manner of limiting the scope of the invention. The invention can be modified and altered as long as such modifications and alterations do not depart from the spirit of the invention, and further equivalents of the invention also fall into the scope of the invention. Moreover, the following embodiments also fall in the scope of the invention.

Liquid Discharge Device

In the above-mentioned embodiments, an ink-jet printer is exemplified as a liquid discharge device (partly) which performs the liquid discharging method but the liquid discharge device is not limited thereto. As long as it is a liquid discharge device, it also can be applied to various industrial apparatuses besides the printer (printing apparatus). For example, the liquid discharge device can be applied to a textile printing apparatus which prints a diagram or a pattern to cloth, a color filter manufacturing apparatus, a display manufacturing apparatus, such as a an organic EL display, a DNA tip manufacturing apparatus for manufacturing a DNA tip by dissolving DNA into tip and applying DNA solution, and a printed circuit board manufacturing apparatus, and the like.

A method of discharging liquid may be a piezo-electric method which discharges liquid in a manner such that a voltage is supplied to a driving element (piezo-element) so that an ink chamber expands or contracts, or may be a thermal method which discharged liquid in a manner such that bubbles are generated in a nozzle using a heater element and the liquid is discharged by the bubbles. In the above-mentioned embodiments, the curl predicting program in the computer 50 connected to the printer 1 predicts the curl state of the print paper (in which case, the computer corresponds to a control portion and the printer and the computer correspond to the liquid discharge device) but the invention is not limited thereto. For example, the controller 10 (corresponding to a control portion) in the printer 1 may predict the curl state of the print paper. In this case, only the printer 1 corresponds to the liquid discharge device.

About Line Head Printer

In the above-mentioned embodiments, the line head printer in which nozzles are arranged in the widthwise direction of a medium which intersects the transportation direction of the medium is exemplified but the invention is not limited thereto. For example, in a case in which the printer is a printer in which a medium is transported in a state in which the medium is absorbed to a lower surface of a transporting belt provided with a hole, the printer may be a serial printer in which an image forming operation in which a single head forms an image while moving in a moving direction which intersects the transportation direction of the medium and a transporting operation for transporting the medium are alternately performed.

Image Data

In the above-mentioned embodiments, the curl predicting program predicts the curl state of the print paper on the basis of image data which is halt-tone processed data by the printer driver, but the invention is not limited thereto. For example, the curl predicting program may predict the curl state of the print paper on the basis of high gray-level gradation data (256 gray levels).

The entire disclosure of Japanese Patent Application No: 2007-319983, filed Dec. 11, 2007 is expressly incorporated by reference herein.

What is claimed is:

1. A curl predicting method comprising:

calculating liquid amount discharged to each of areas defined on a medium by a liquid discharge device for every area defined on the medium; and predicting a curl state of the medium which is attributable to liquid discharged to the medium on the basis of a position of the area on the medium and the amount of the liquid discharged to the area.

2. The curl predicting method according to claim 1, wherein the amount of the liquid is converted to force which causes the medium to curl for every area and a degree of curl for each area is predicted for every area on the basis of the force which causes the medium to curl.

3. The curl predicting method according to claim 2, wherein when converting the amount of the liquid amount to the force which causes the medium to curl, force which causes the medium to curl in a predetermined direction of the medium and force which causes the medium to curl in a direction which perpendicularly intersects the predetermined direction are differently set.

4. The curl predicting method according to claim 2, wherein when converting the liquid amount of a certain area to the force which causes the medium to curl in a predetermined direction of the medium, the liquid amount of each of areas which parallel the certain area in a direction which perpendicularly intersects the predetermined direction more significantly affects the curl state than the liquid amount of each of areas which parallel the certain area in the predetermined direction; and when converting the liquid amount of the certain area to the force which causes the medium to curl in a direction which perpendicularly intersects the predetermined direction of the medium, the liquid amount of each of areas which parallel the certain area in the predetermined direction more significantly affects the curl state than the liquid amount of each of areas which parallel the certain area in the direction which perpendicularly intersects the predetermined direction.

5. The curl predicting method according to claim 2, wherein the force is force which causes the medium to curl in a manner such that a surface of the medium to which liquid is discharged becomes an inside surface; moment force generated at a certain area by a weight of a portion of the medium which ranges from the certain area to an end of the medium is calculated for every area; and a curl state of each of the areas is predicted for every area on the basis of a difference between the force and the moment force.

6. The curl predicting method according to claim 5, wherein in the case in which the force for the certain area is larger than the moment force for the certain area, it is predicted that the area be curled, but in the case in which the force for the certain area is equal to or weaker than the moment force, it is predicted that the area be not curled.

7. The curl predicting method according to claim 2, wherein a curl amount for a center-positioned area on the medium is determined to have a predetermined value, a curl amount for a certain area is calculated on the basis of curl amounts for adjacent areas which are adjacent to the certain area and are positioned to be nearer the center portion of the medium than the certain area, and the curl amount for each of the adjacent areas is calculated in sequence order from the center-positioned area to an area at an end portion of the medium.

8. A liquid discharge device comprising:

a nozzle for discharging liquid to a medium; and a control portion which produces image data for discharging liquid from the nozzle, wherein the control portion calculates amount of liquid to be discharged to an area of the medium which corresponds to an area defined in the image data, and predicts a curl state of the medium which is attributable to the liquid discharged to the medium on the basis a position of the area on the medium and the amount of the liquid discharged to the area.

* * * * *